US009981475B2

(12) United States Patent
Watanabe et al.

(10) Patent No.: US 9,981,475 B2
(45) Date of Patent: May 29, 2018

(54) INK SUPPLY APPARATUS AND INK JET RECORDING APPARATUS

(71) Applicant: CANON KABUSHIKI KAISHA, Tokyo (JP)

(72) Inventors: Shigeru Watanabe, Yokohama (JP); Kouhei Tokuda, Tokyo (JP); Tsutomu Obata, Tokyo (JP); Hiroyuki Matsunaka, Hachioji (JP); Naoaki Wada, Yokohama (JP); Eiichi Adachi, Kawasaki (JP); Noriyuki Aoki, Tokyo (JP); Toshiro Sugiyama, Yokohama (JP); Ryohei Maruyama, Kawasaki (JP); Ryuichi Kato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 14/961,681

(22) Filed: Dec. 7, 2015

(65) Prior Publication Data

US 2016/0167393 A1 Jun. 16, 2016

(30) Foreign Application Priority Data

Dec. 10, 2014 (JP) ..... 2014-250406
Sep. 30, 2015 (JP) ..... 2015-193488

(51) Int. Cl.
*B41J 2/175* (2006.01)

(52) U.S. Cl.
CPC ..... *B41J 2/17513* (2013.01); *B41J 2/175* (2013.01)

(58) Field of Classification Search
CPC ..... B41J 2/18; B41J 2/175; B41J 2/17513
See application file for complete search history.

(56) References Cited

U.S. PATENT DOCUMENTS

2010/0157002 A1* 6/2010 Takada ..... B41J 2/17509 347/85
2012/0127243 A1* 5/2012 Kumagai ..... B41J 2/18 347/85
2013/0235133 A1* 9/2013 Watanabe ..... B41J 2/16532 347/92
2015/0097881 A1* 4/2015 Kimura ..... B41J 2/175 347/6

FOREIGN PATENT DOCUMENTS

JP 2007313830 A 12/2007

* cited by examiner

*Primary Examiner* — Alessandro Amari
*Assistant Examiner* — Roger W Pisha, II
(74) *Attorney, Agent, or Firm* — Canon U.S.A., Inc. IP Division

(57) ABSTRACT

An ink supply apparatus includes a first ink tank, a second ink tank, a first flow path configured to connect the first ink tank and the second ink tank, a volume change unit disposed on the first flow path, configured to be able to change an internal volume of its own, and allow ink to flow thereinto from the first flow path when the internal volume is expanded and to flow out to the first flow path when the internal volume is reduced, a first opening and closing unit disposed between the first ink tank and the volume change unit, and a second opening and closing unit disposed between the second ink tank and the volume change unit.

15 Claims, 19 Drawing Sheets

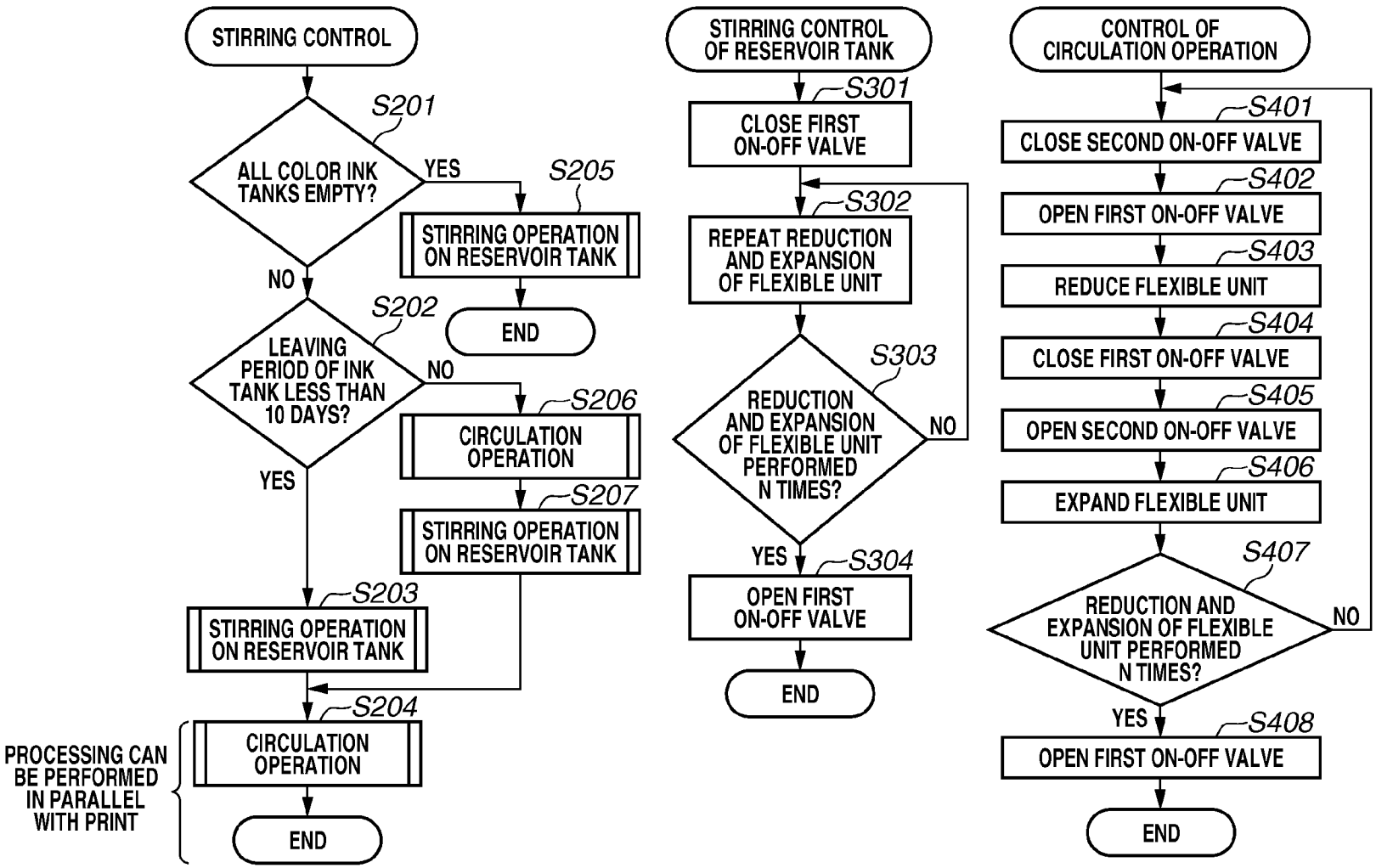
FIG.14A
STIRRING CONTROL
S201
ALL COLOR INK TANKS EMPTY?
YES
S205
STIRRING OPERATION ON RESERVOIR TANK
END
NO
S202
LEAVING PERIOD OF INK TANK LESS THAN 10 DAYS?
NO
S206
CIRCULATION OPERATION
S207
STIRRING OPERATION ON RESERVOIR TANK
YES
S203
STIRRING OPERATION ON RESERVOIR TANK
S204
CIRCULATION OPERATION
END
PROCESSING CAN BE PERFORMED IN PARALLEL WITH PRINT
FIG.14B
STIRRING CONTROL OF RESERVOIR TANK
S301
CLOSE FIRST ON-OFF VALVE
S302
REPEAT REDUCTION AND EXPANSION OF FLEXIBLE UNIT
S303
REDUCTION AND EXPANSION OF FLEXIBLE UNIT PERFORMED N TIMES?
NO
YES
S304
OPEN FIRST ON-OFF VALVE
END
FIG.14C
CONTROL OF CIRCULATION OPERATION
S401
CLOSE SECOND ON-OFF VALVE
S402
OPEN FIRST ON-OFF VALVE
S403
REDUCE FLEXIBLE UNIT
S404
CLOSE FIRST ON-OFF VALVE
S405
OPEN SECOND ON-OFF VALVE
S406
EXPAND FLEXIBLE UNIT
S407
REDUCTION AND EXPANSION OF FLEXIBLE UNIT PERFORMED N TIMES?
NO
YES
S408
OPEN FIRST ON-OFF VALVE
END

INK SUPPLY APPARATUS AND INK JET RECORDING APPARATUS

BACKGROUND OF THE INVENTION

Field of the Invention

The present invention relates to an ink supply apparatus including a reservoir tank and an ink jet recording apparatus.

Description of the Related Art

Recently, ink jet recording apparatuses including reservoir tanks have been widely used as production apparatuses. Such ink jet recording apparatuses can continue recording operations using ink in the reservoir tanks if the ink tanks become empty (hereinbelow, referred to as "stop-less recording"). In addition, the ink jet recording apparatuses can change the ink tanks during a period when the recording operations are continued using the ink in the reservoir tanks.

On the other hand, regarding the ink used by the ink jet recording apparatuses, ink components in the solution (ink) settle down by being left, and the ink concentration distribution in the ink tanks become uneven in some cases. Especially, such an issue is more likely to occur in the ink jet recording apparatuses using pigment ink. Thus, it is necessary for the ink jet recording apparatuses to regularly stir the ink in the ink tanks and the reservoir tanks.

For example, an ink jet recording apparatus discussed in Japanese Patent Application Laid-Open No. 2007-313830 (see FIG. 12A) includes an ink tank 130 and a sub tank 330' (a reservoir tank) which are arranged vertically. Further, a first flow path (a flow path on an ink introduction needle 321 side) and a second flow path (a flow path on an air introduction needle 322 side) are disposed between the ink tank 130 and the sub tank 330', and the ink tank 130 and the sub tank 330' communicate with each other by these flow paths. Furthermore, a lower end of the first flow path is arranged lower than a lower end of the second flow path in the sub tank 330' so that the ink flows from the ink tank 130 to the sub tank 330'.

Accordingly, air in the sub tank moves to the ink tank through the second flow path based on a water head difference, and also the ink in the ink tank 130 is automatically supplied to the sub tank 330' through the first flow path.

According to the invention described in Japanese Patent Application Laid-Open No. 2007-313830, a pump mechanism (see FIG. 12B) including a piston 510 reciprocating in a cylinder 500 is disposed in the first flow path (the flow path on the ink introduction needle 321 side) as an ink stirring unit.

By the operations of the pump mechanism, the ink flows from the ink tank 130 to the sub tank 330' through the first flow path 321, and further the ink reserved in the sub tank 330' flows (returns) to the ink tank 130 through the second flow path 322. The operations of the pump mechanism are repeated as described above, so that the ink is circulated and stirred between the ink tank 130 and the sub tank 330'.

According to the recording apparatus described in Japanese Patent Application Laid-Open No. 2007-313830, the ink in the ink tank is moved bit by bit to the sub tank by the pump mechanism and diluted and stirred in the sub tank.

On the other hand, the movement of the ink from the ink tank to the sub tank generates a minute negative pressure in the ink tank, and the ink in the sub tank is returned again to the ink tank bit by bit by the minute negative pressure. An ink flow returning to the ink tank is weak, and a stirring (raising) effect is low with respect to the high concentration ink settled down in the bottom of the ink tank. Therefore, it is necessary to improve ink stirring efficiency in the ink tank and the sub tank.

SUMMARY OF THE INVENTION

Aspects of the present invention are generally directed to the provision of an ink supply apparatus and an ink jet recording apparatus capable of improving ink stirring efficiency in consideration of the above-described issue.

Another aspect of the present invention is to provide an ink supply apparatus including:

a first ink tank configured to store ink;

a second ink tank configured to store ink supplied from the first ink tank;

a first flow path configured to connect the first ink tank and the second ink tank;

a volume change unit disposed on the first flow path and configured to be able to change an internal volume of its own and allow ink to flow thereinto from the first flow path when the internal volume is expanded and to flow out to the first flow path when the internal volume is reduced;

a first opening and closing unit disposed between the first ink tank and the volume change unit and configured to be able to open and close the first flow path; and a second opening and closing unit disposed between the second ink tank and the volume change unit and configured to be able to open and close the first flow path.

Further another aspect of the present invention is to provide an ink supply apparatus including:

a first ink tank configured to store ink;

a second ink tank configured to store ink supplied from the first ink tank;

an ink supply path configured to supply ink from the first ink tank to the second ink tank; and an ink stirring mechanism configured to perform a first stirring operation in which ink is stirred by being moved between the ink supply path and the first ink tank under a state where ink is set to be immovable from the ink supply path to the second ink tank, and a second stirring operation in which ink is stirred by being moved between the ink supply path and the second ink tank under a state where ink is set to be immovable from the ink supply path to the first ink tank.

Yet another aspect of the present invention is to provide an ink supply apparatus including:

a first ink tank configured to store ink;

a second ink tank disposed below the first ink tank, configured to store ink supplied from the first ink tank, and including an atmosphere communication portion;

a first flow path configured to connect the first ink tank and the second ink tank and including a first opening portion opening in the second ink tank;

a second flow path configured to connect the first ink tank and the second ink tank and including a second opening portion opening on a position higher than the first opening portion in the second ink tank, wherein ink is supplied from the first ink tank to the second ink tank through the first flow path, and air is supplied from the second ink tank to the first ink tank through the second flow path; and a circulation mechanism configured to perform a circulation operation for circulating ink in the first ink tank and the second ink tank by moving ink from the second ink tank to the first ink tank through the first flow path and moving ink from the first ink tank to the second ink tank through the second flow path.

Further features of the present invention will become apparent from the following description of exemplary embodiments with reference to the attached drawings.

BRIEF DESCRIPTION OF THE DRAWINGS

FIGS. 14A to 14C are flowcharts illustrating stirring control according to the fifth exemplary embodiment.

DESCRIPTION OF THE EMBODIMENTS

A first exemplary embodiment of the present invention is described below with reference to FIG. 1 to FIGS. 6A to 6C.

According to the present exemplary embodiment, a serial type ink jet recording apparatus is described as an example of an ink jet recording apparatus. In addition, an ink supply apparatus is a part of the ink jet recording apparatus.

1. Ink Jet Recording Apparatus

(1-1) General Arrangement of Ink Jet Recording Apparatus

Figure 1:
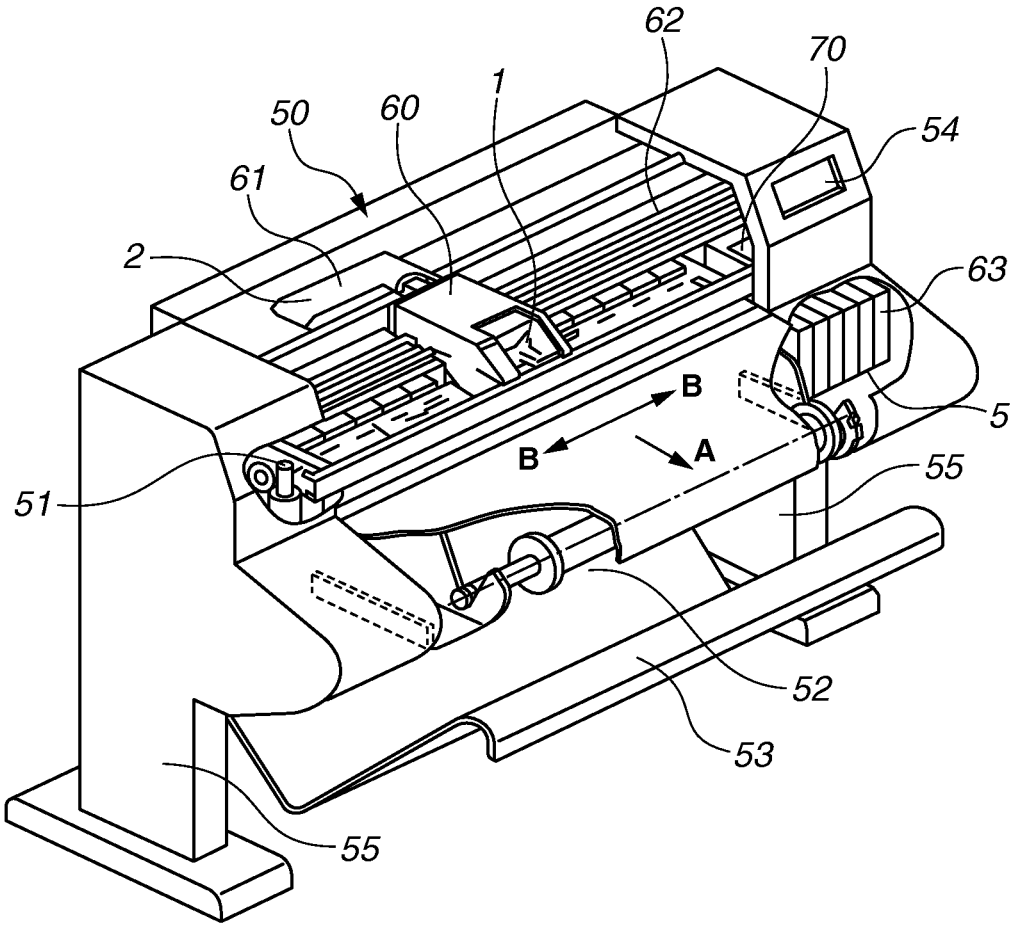
FIG. 1 is a perspective schematic view illustrating an ink jet recording apparatus according to a first exemplary embodiment the present invention.

FIG. 1 is a perspective schematic view illustrating the ink jet recording apparatus according to the first exemplary embodiment the present invention.

As illustrated in FIG. 1, an ink jet recording apparatus 50 (hereinbelow, simply referred to as the "recording apparatus") is fixed to extend over upper ends of two leg portions 55 facing each other. A carriage 60 is provided with a head 1 (a recording head).

When recording is performed, a recording medium set in a conveyance roll holder unit 52 is fed (conveyed) to a recording position. The carriage 60 is reciprocated in a main scanning direction B-B by a carriage motor (not illustrated) and a belt transmission unit 62, and ink droplets are discharged from each nozzle in the head 1. When the carriage 60 moves to one end of the recording medium, a conveyance roller 51 conveys the recording medium for a predetermined amount to a sub-scanning direction A.

The recording operation and the conveyance operation are alternately repeated as described above, and thus an image is formed on the entire recording medium. After image formation, the recording medium is cut by a cutter (not illustrated), and the cut recording medium is stacked on a stacker 53.

An ink supply unit 63 is provided with ink tanks 5 (first ink tanks) which are separated by ink colors, such as black, cyan, magenta, and yellow, and the respective color inks are stored therein. The ink tank 5 is connected to a supply tube 2 (an ink flow path) via a reservoir tank 4 (a second ink tank), which is described below. The supply tube 2 (the ink flow path) is bound with a tube guide 61 so as not to be an obstacle in the reciprocation movement of the carriage 60.

On a surface of the head 1 facing the recording medium, a plurality of nozzle rows (not illustrated) is provided in a direction approximately orthogonal to the main scanning direction B-B and connected to the supply tube 2 (the ink flow path) per nozzle row.

A recovery unit 70 is disposed on a position which is out of an area of the recording medium in the main scanning direction B-B and faces the nozzle surface of the head 1. The recovery unit 70 includes a suction unit which sucks ink or air from a discharge port surface of the head 1 to clean nozzles and forcibly sucks air stored in the head as necessary.

An operation panel 54 is disposed on a right side of the recording apparatus 50 (see FIG. 1), and a user can input an instruction to the recording apparatus 50 therefrom. In addition, when the ink tank 5 becomes empty of ink, the operation panel 54 may display a warning to prompt a user to change the ink tank 5.

Figure 2:
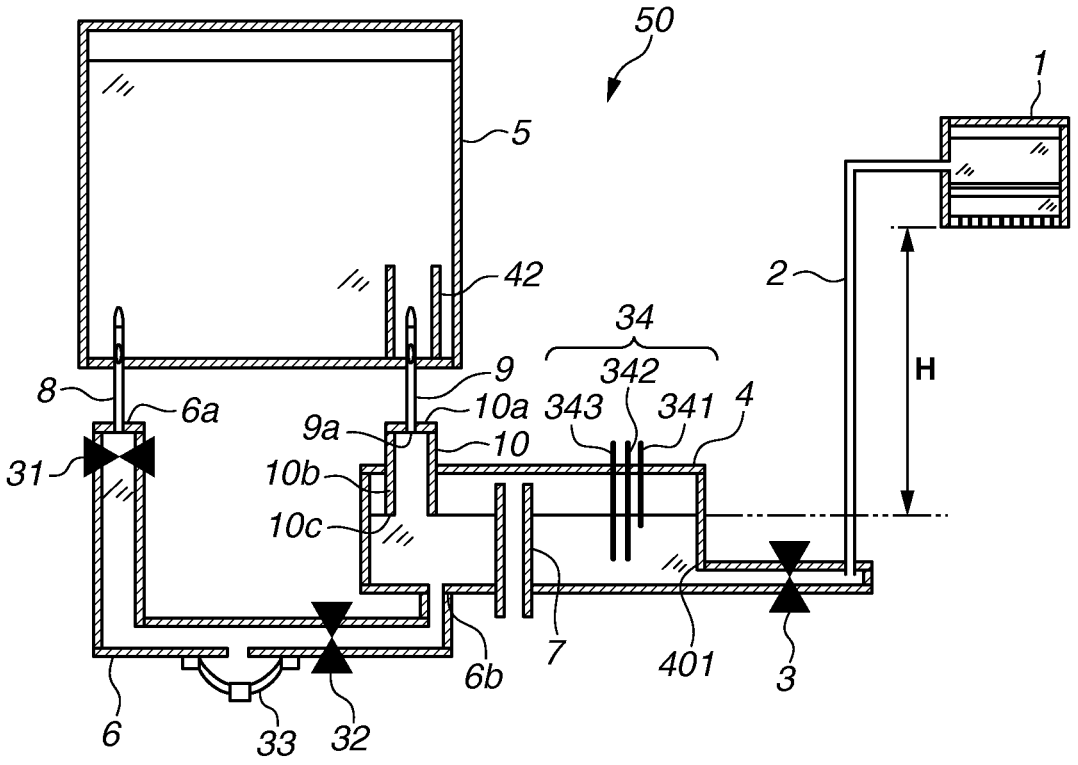
FIG. 2 is a schematic diagram illustrating ink flow paths of the ink jet recording apparatus according to the first exemplary embodiment.

FIG. 2 is a schematic diagram illustrating the ink flow paths of the ink jet recording apparatus according to the first exemplary embodiment. According to the present exemplary embodiment, the ink flow path for a single color is described as an example, however, the same can be applied to the ink flow paths for a plurality of colors.

As illustrated in FIG. 2, the recording apparatus 50 according to the present exemplary embodiment mainly includes the ink tank 5 for storing ink, the reservoir tank 4 for storing the ink supplied from the ink tank 5, and the head 1 for performing recording using the ink supplied from the reservoir tank 4.

The reservoir tank 4 is disposed below the ink tank 5. An ink supply path 6 for supplying the ink from the ink tank 5 to the reservoir tank 4 and an air introduction path 10 for introducing air from the reservoir tank 4 to the ink tank 5 are disposed between the ink tank 5 and the reservoir tank 4.

The reservoir tank 4 includes an atmosphere communication portion 7 for communicating with atmosphere and is opened to the atmosphere. On the other hand, the ink tank 5 does not include an atmosphere communication portion and is not opened to the atmosphere. The ink tank 5 is attachable to and detachable from the reservoir tank 4 (an apparatus main body).

The ink tank 5 has an inner space for storing ink and is provided with two joint portions on the bottom. Into the joint portions, a first hollow tube 8 and a second hollow tube 9 described below can be inserted. Around the second hollow tube 9 inserted into the ink tank 5, a standing wall 42 with a cylindrical shape is disposed to stand on the bottom (a bottom surface) of the ink tank 5 so as to surround the second hollow tube 9.

One end 6*a* of the ink supply path 6 is connected to the first hollow tube 8, and the other end 6*b* thereof is connected to a bottom of the reservoir tank 4.

On the other hand, one end 10*a* of the air introduction path 10 is connected to the second hollow tube 9, and the other end 10*b* thereof is connected to an upper portion (an upper surface) of the reservoir tank 4. The other end 10*b* of the air introduction path 10 is inserted into the reservoir tank 4 from the upper surface of the reservoir tank 4 and has an opening 10*c*.

More specifically, a position of an opening (the other end 6*b*) of the ink supply path 6 is arranged lower than a position of the opening 10*c* of the air introduction path 10 in the reservoir tank 4. Therefore, when ink is supplied from the ink tank 5 to the reservoir tank 4 through the ink supply path 6 (and the first hollow tube 8), air is introduced from the reservoir tank 4 to the ink tank 5 through the air introduction path 10 (and the second hollow tube 9) by the water head difference.

On the other hand, when a liquid surface in the reservoir tank 4 rises and fills the opening 10*c*, movement of the air from the reservoir tank 4 to the ink tank 5 is stopped, and ink supply from the ink tank 5 to the reservoir tank 4 is also stopped.

As described above, when the ink in the reservoir tank 4 is consumed and the liquid surface is lowered, the air is introduced to the ink tank 5 through the air introduction path 10, and the ink is automatically supplied to the reservoir tank 4 (the bird feed supply system). Until the ink tank 5 becomes empty of ink therein, the ink liquid surface in the reservoir tank 4 is placed approximately at the same height of the opening 10*c* of the air introduction path 10.

The reservoir tank 4 is provided with metal solid tubes 341 to 343 as electrodes 34. A lower end of the first solid tube 341 is arranged slightly lower (about 4 mm below according to the present exemplary embodiment) than the opening 10*c* of the air introduction path 10. Accordingly, a full tank state of the reservoir tank 4 can be certainly detected. The second solid tube 342 and the third solid tube 343 have approximately the same length, and lower ends of them are both placed lower than a lower end of the first solid tube 341 and higher than an ink flow-out port 401 from the reservoir tank 4 to the head 1.

Accordingly, when a weak voltage is applied between the first solid tube 341 and the third solid tube 343, and if the ink in the reservoir tank 4 is in the full tank state, an electric current flows between the electrodes, and a resistance value between the two electrodes becomes lower. As described above, whether the reservoir tank 4 is in the "full tank state" or not can be detected based on a change in the resistance value between the electrodes.

Similarly, when a weak voltage is applied between the second solid tube 342 and the third solid tube 343, and if the ink liquid surface in the reservoir tank 4 is lower than the lower end of the electrode 34, an electric current does not flow between the two electrodes, and the resistance value therebetween becomes higher. As described above, whether the reservoir tank 4 is in an "empty state" or not can be detected based on a change in the resistance value between the electrodes.

As long as the ink is present in the ink tank 5, the reservoir tank 4 can be brought into the "full tank state" based on the bird feed supply system. Thus, when the electrode 34 detects that the ink in the reservoir tank 4 is not in the "full tank state", it can be estimated that the ink in the ink tank 5 is in the empty state. In other words, the electrode 34 can also detect the "empty state" of the ink tank 5.

According to the present exemplary embodiment, the ink flow-out port 401 is disposed on a lowest position on a side surface of the reservoir tank 4. In addition, an on-off valve 3 is disposed between the reservoir tank 4 and the supply tube 2. The on-off valve 3 is disposed, and thus "removal of air from the head and filling of ink into the head" described below can be smoothly performed.

According to the present exemplary embodiment, the on-off valve 3 is driven by the same driving source of a below-described ink stirring mechanism, however, the on-off valve 3 may be driven by a different driving source. In addition, on-off valves in the ink flow paths for a plurality of colors may be configured to be driven at the same time.

According to the present exemplary embodiment, the ink in the head 1 is maintained under a negative pressure by a water head difference H (see FIG. 2) between the ink liquid surface in the reservoir tank 4 and the discharge port surface of the head 1. According to the present exemplary embodiment, the water head difference H is about 80 mm.

When air is stored in the head 1, it is necessary to forcibly remove the air from the head. As a method for removing the air in the head, the head 1 is sucked by the recovery unit 70 (see FIG. 1) while the on-off valve 3 is closed.

More specifically, a cap (not illustrated) is tightly attached to the discharge port surface of the head 1, and air is sucked by driving a pump (not illustrated). The suction is performed for a predetermined time length (about 25 seconds according to the present exemplary embodiment), and the on-off valve 3 is opened, so that the head is filled with the ink. In other words, the on-off valve 3 is opened after the suction, and thus a predetermined amount of ink is sucked from the reservoir tank 4 to the head 1 by the negative pressure in the head. Accordingly, the head is filled with the ink. As the ink in the head 1 is consumed, the ink is supplied to the head 1 again in the order of the ink tank 5 and the reservoir tank 4.

(1-2) Control Mechanism of Ink Jet Recording Apparatus

Figure 3:
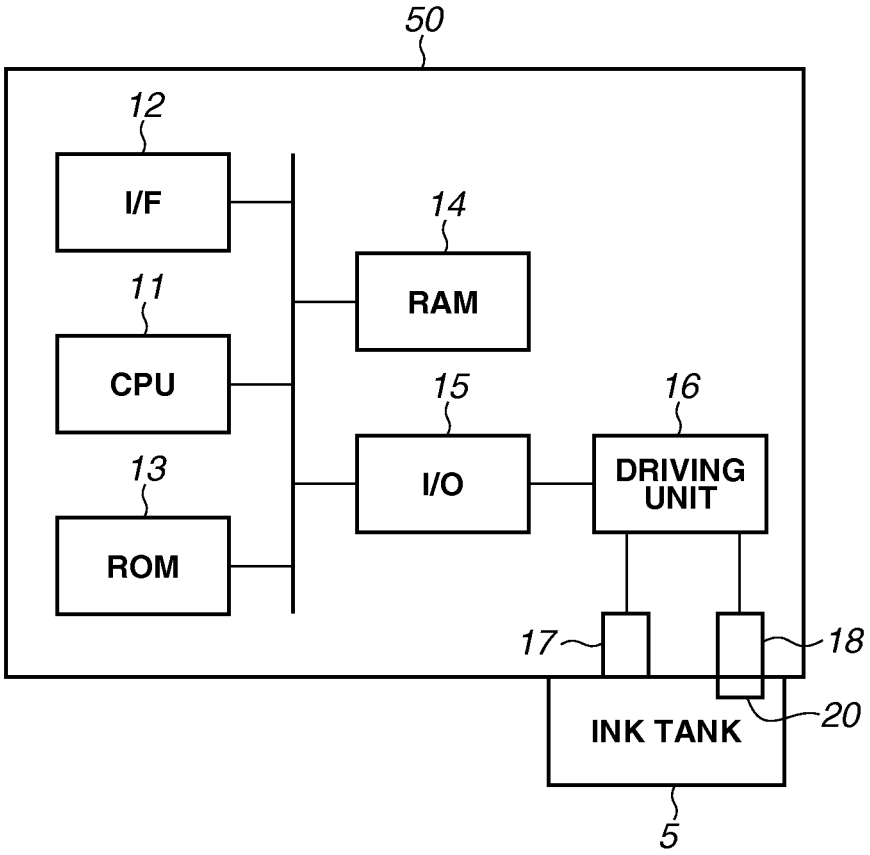
FIG. 3 is a block diagram illustrating the ink jet recording apparatus according to the first exemplary embodiment.

FIG. 3 is a block diagram illustrating a control mechanism of the ink jet recording apparatus according to the first exemplary embodiment.

As illustrated in FIG. 3, the recording apparatus 50 according to the present exemplary embodiment mainly includes a central processing unit (CPU) 11 for controlling the recording apparatus and a user interface 12 including an operation panel for displaying keys to be operated by a user and information. The recording apparatus 50 further includes a read only memory (ROM) 13 incorporating control software and a random access memory (RAM) 14 temporarily used when the control software is operated. Furthermore, the recording apparatus 50 includes a driving unit input/output (I/O) 15, a driving unit 16, a detection unit 17 for detecting an ink amount, and an ink tank mounting sensor 18 for detecting attachment and detachment of the ink tank.

According to the present exemplary embodiment, the detection unit 17 includes the electrode 34 and an electric circuit to be connected to the electrode 34 and detects liquid surface information in the reservoir tank 4 from a voltage value of the electrode 34. In addition, the detection unit 17 may include a configuration for detecting an ink amount in the ink tank 5.

The ink tank mounting sensor 18 determines an attachment and detachment state by a read value of an electrically erasable and programmable read only memory (EEPROM) attached to the ink tank 5. In addition, the ink tank mounting sensor 18 is used to read and write contents (recording information) in the EEPROM 20. In other words, every time the ink is used, a remaining amount in the ink tank 5 is recorded in the EEPROM 20, and remaining amount management of the ink tank 5 is performed.

2. Ink Stirring Mechanism (2-1) Configuration of Ink Stirring Mechanism

The ink stirring mechanism according to the present exemplary embodiment is described below.

The ink stirring mechanism is disposed on the ink supply path 6 and includes a first on-off valve 31 (a first opening and closing unit), a second on-off valve 32 (a second opening and closing unit), and a flexible unit 33 (a volume change unit). The first on-off valve 31 and the second on-off valve 32 are openable and closable.

More specifically, the first on-off valve 31 is disposed between the ink tank 5 and the flexible unit 33, and the second on-off valve 32 is disposed between the reservoir tank 4 and the flexible unit 33. The first on-off valve 31 and the second on-off valve 32 each are switched between an open state and a close state, so that the ink supply path 6 can be opened and closed. The flexible unit 33 is configured with members which have flexibility and can change an internal volume of its own. The flexible unit 33 is deformed to change the internal volume, so that the ink can flow in and out the flexible unit 33. According to the present exemplary embodiment, the first on-off valve 31, the second on-off valve 32, and the flexible unit 33 are driven by a common driving mechanism (not illustrated).

According to the present exemplary embodiment, the flexible unit 33 is disposed on a lowest part of the ink supply path 6 in the direction of gravity. Accordingly, the flexible unit 33 can efficiently move the ink with less air bubble incorporation. According to the present exemplary embodiment, a variable volume of the flexible unit 33 is set to about 0.7 to 1 ml. The arrangement and the internal volume of the flexible unit 33 can be appropriately changed to perform operations.

(2-2) Control of Ink Stirring Mechanism

According to the present exemplary embodiment, stirring control of the ink stirring mechanism includes a stirring operation with respect to the ink tank 5 (a first stirring operation) and a stirring operation with respect to the reservoir tank 4 (a second stirring operation).

According to the present exemplary embodiment, the stirring control of the ink stirring mechanism is performed when a predetermined time length has elapsed since the last stirring operation and when the ink tank 5 is changed. A time length to perform stirring can be changed according to the elapsed time. For example, as the elapsed time is longer, the stirring time length can be set longer.

The control of the ink stirring mechanism (the stirring operation) according to the present exemplary embodiment is described in detail below.

Figure 4A:
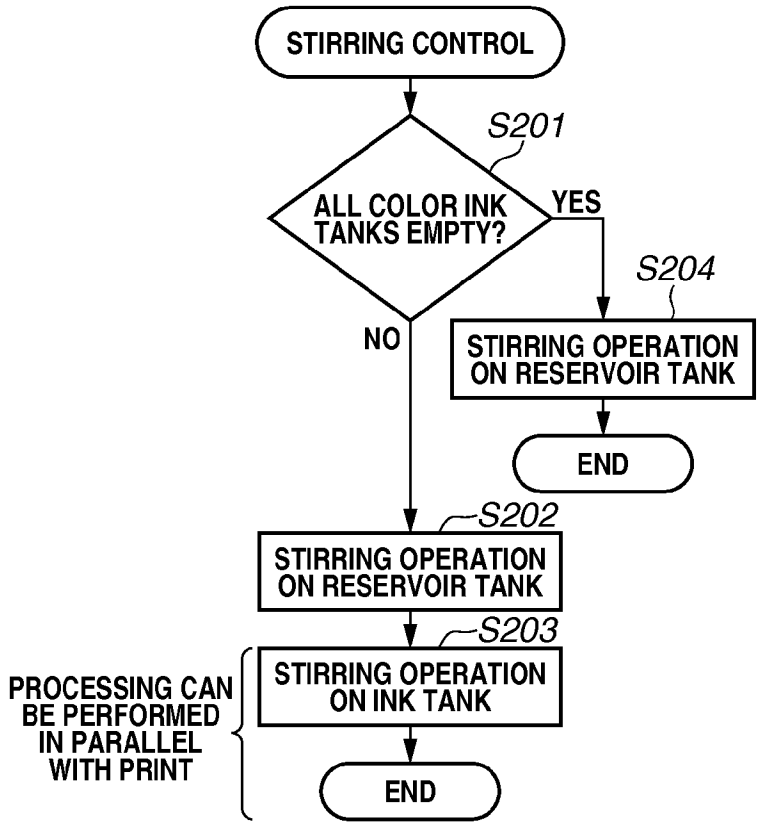
FIGS. 4A to 4C are flowcharts illustrating stirring control according to the first exemplary embodiment.
Figure 4B:
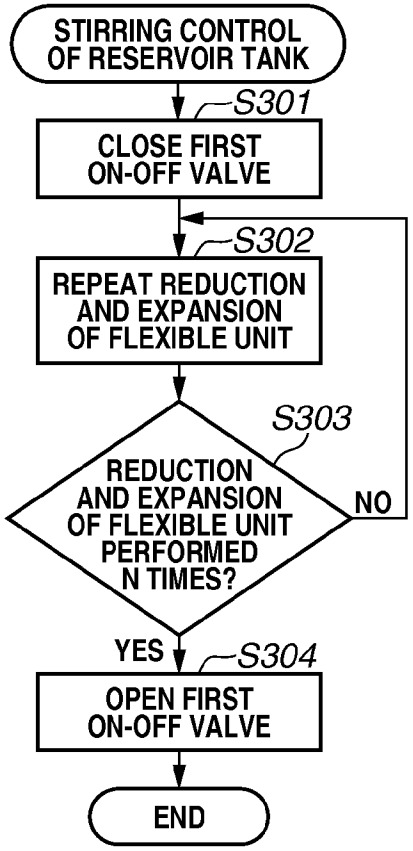
Figure 4C:
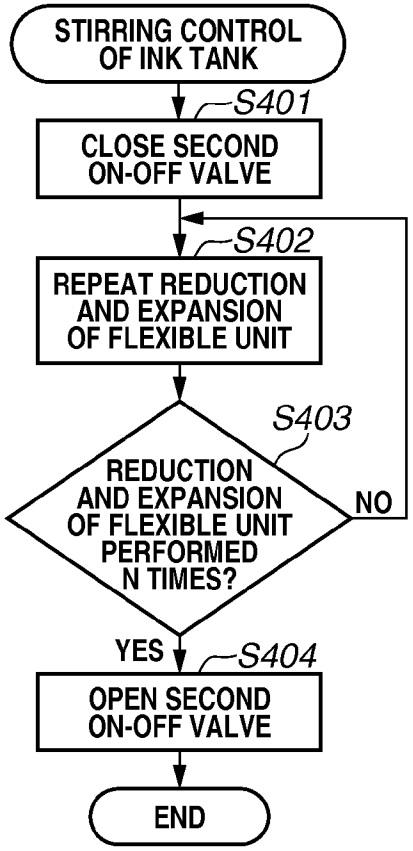
Figure 5A:
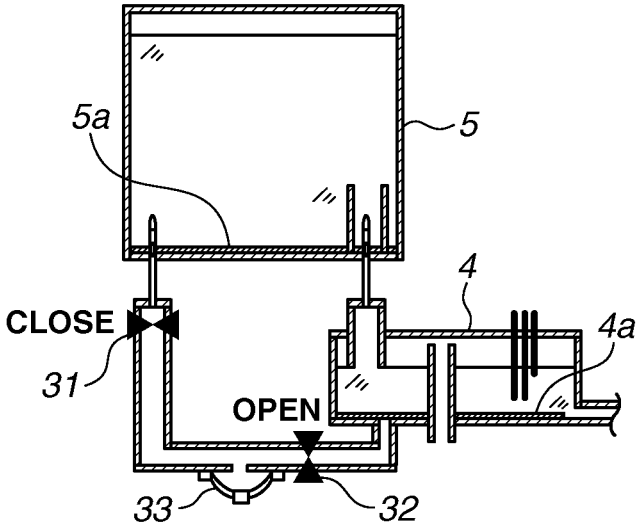
FIGS. 5A to 5C are schematic diagrams illustrating ink stirring operations in a reservoir tank according to the first exemplary embodiment.
Figure 5B:
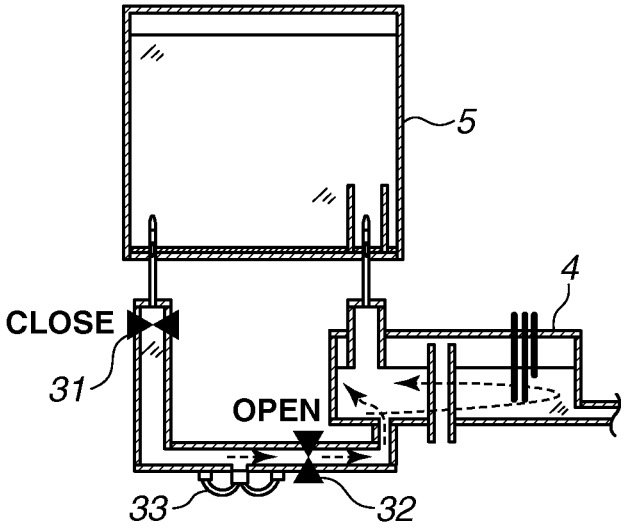
Figure 5C:
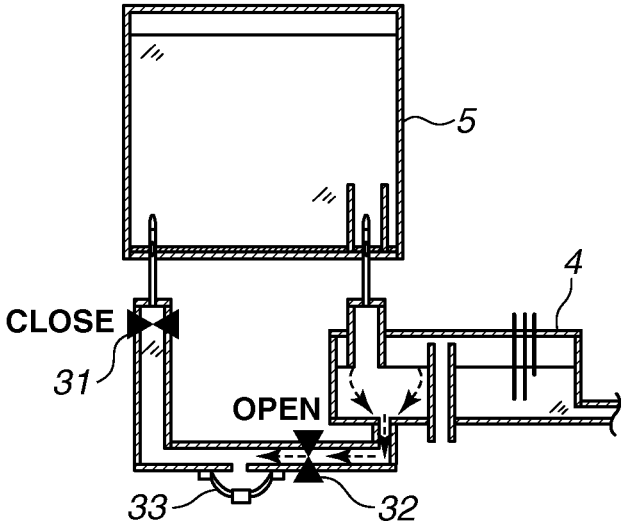
Figure 6A:
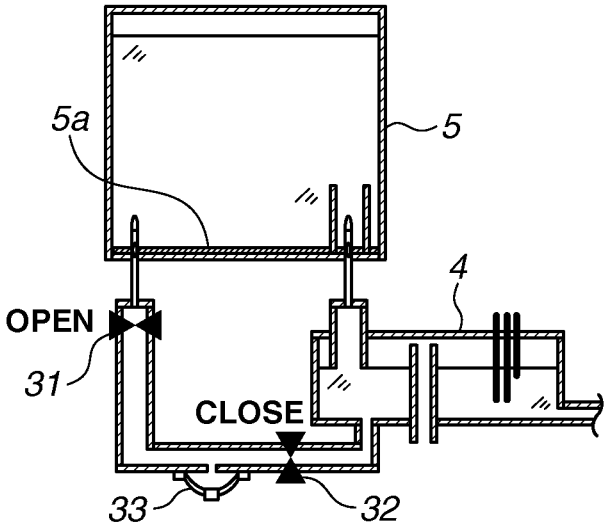
FIGS. 6A to 6C are schematic diagrams illustrating ink stirring operations in an ink tank according to the first exemplary embodiment.
Figure 6B:
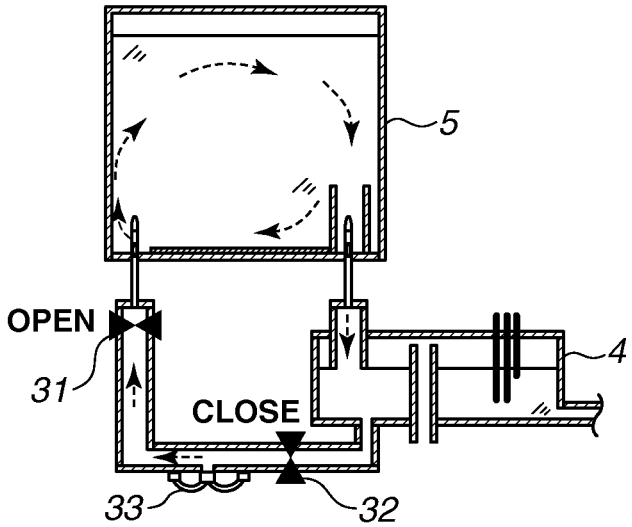
Figure 6C:
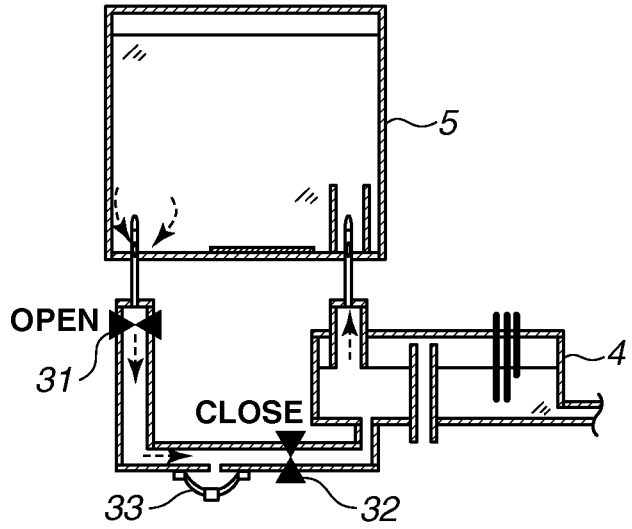

FIGS. 4A to 4C are flowcharts illustrating the ink stirring control according to the present exemplary embodiment. FIGS. 5A to 5C are schematic diagrams illustrating the ink stirring operations in the reservoir tank according to the present exemplary embodiment. Further, FIGS. 6A to 6C are schematic diagrams illustrating the ink stirring operations in the ink tank according to the present exemplary embodiment.

As illustrated in FIG. 5A, when time has elapsed while leaving the ink tank 5 and the reservoir tank 4 untouched, precipitated high concentration ink layers 5*a* and 4*a* are respectively generated in the ink tank 5 and the reservoir tank 4.

When the stirring operation is required as in the above-described case, as illustrated in FIG. 4A, first in step S201, it is determined whether the ink tanks 5 of all colors are in the "empty state". As described above, the determination of the "empty state" of the ink tank 5 is estimated from that the reservoir tank 4 is not in the "full tank state". In other words, when the detection unit 17 detects that the reservoir tank 4 is not the "full tank state" (i.e., an OFF signal) based on an electric signal from the electrode 34 in the reservoir tank 4, it is determined that the ink tank 5 is in the "empty state".

Next, if it is determined that the ink tank 5 of any one color among a plurality of color inks is not in the "empty state" (NO in step S201), in step S202, the stirring operation of the reservoir tank 4 (the second stirring operation) is performed. Then, after the stirring operation of the reservoir tank 4 is finished, in step S203, the stirring operation of the ink tank 5 (the first stirring operation) is performed. In other words, the second stirring operation (stirring of the reservoir tank 4) can be performed before the first stirring operation (stirring of the ink tank 5) unless all of the ink tanks 5 are not in the "empty state".

Accordingly, the recording operation can be started at an early point when the stirring operation of the reservoir tank 4 is finished which contributes to reduction of down-time. The stirring operation of the ink tank 5 may be performed while performing the recording operation.

On the other hand, when the ink tanks in the ink flow paths of the plurality of colors are all in the empty state (YES in step S201, in other words, the reservoir tank 4 is not the "full tank state" and the OFF signal), in step S204, only the stirring operation of the reservoir tank 4 is performed.

A detail flowchart of the stirring control of the reservoir tank 4 is illustrated in FIG. 4B, and a detail flowchart of the stirring control of the ink tank 5 is illustrated in FIG. 4C.

(A) Stirring Control of Reservoir Tank

As illustrated in FIG. 4B, as a method for the stirring control of the reservoir tank 4, first in step S301, the first on-off valve 31 is closed. (A state illustrated in FIG. 5A)

In step S302, the flexible unit 33 is reduced (in volume) and deformed. (A state illustrated in FIG. 5B)

As illustrated in FIG. 5B, when the flexible unit 33 is reduced and deformed while the first on-off valve 31 is closed, the ink is not pushed out from the ink supply path 6 to the ink tank 5 side, and the ink corresponding to a changed amount in the flexible unit 33 is pushed out to the reservoir tank 4 side.

Accordingly, a large flow of the ink is generated in the reservoir tank 4, and the precipitated high concentration ink layer 4*a* is raised and stirred.

Subsequently, in step S302, the flexible unit 33 is expanded (in volume) and deformed as illustrated in FIG. 5C, so that the ink in the reservoir tank 4 is drawn into the ink supply path 6 by the changed amount of the flexible unit 33.

In step S303, a volume change operation of the flexible unit 33 is executed for a plurality of times (N times) as described above.

The operation is thus repeatedly executed to create the states in FIGS. 5B and 5C, so that the ink in the reservoir tank 4 can be effectively stirred, and an ink concentration in the reservoir tank 4 can be uniformed.

When the volume change operation is completed for the number of times (N times) determined according to an elapsed (leaving) period (YES in step S303), in step S304, the first on-off valve 31 is opened, and the stirring control of the reservoir tank 4 is complete.

(B) Stirring Control of Ink Tank

As illustrated in FIG. 4C, as a method for the stirring control of the ink tank 5, first in step S401, the second on-off valve 32 is closed. (A state illustrated in FIG. 6A)

In step S402, the flexible unit 33 is reduced (in volume) and deformed. (A state illustrated in FIG. 6B)

As illustrated in FIG. 6B, when the flexible unit 33 is reduced and deformed while the second on-off valve 32 is closed, the ink is not pushed out from the ink supply path 6 to the reservoir tank 4 side, and the ink corresponding to a changed amount in the flexible unit 33 is pushed out to the ink tank 5 side.

Accordingly, a large flow of the ink is generated in the ink tank 5, and the precipitated high concentration ink layer 5*a* is raised and stirred.

Subsequently, in step S402, the flexible unit 33 is expanded (in volume) and deformed as illustrated in FIG. 6C, so that the ink in the ink tank 5 is drawn into the ink supply path 6 by the changed amount of the flexible unit 33.

In step S403, the volume change operation of the flexible unit 33 is executed for a plurality of times (N times) as described above.

The operation is thus repeatedly executed to create the states in FIGS. 6B and 6C, so that the ink in the ink tank 5 can be effectively stirred, and an ink concentration in the ink tank 5 can be uniformed.

When the volume change operation is completed for the number of times (N times) determined according to an elapsed (leaving) period (YES in step S403), in step S404, the first on-off valve 31 is opened, and the stirring control of the ink tank 5 is complete.

When the ink is pushed out to the ink tank 5, a portion of the ink may be pushed out from the ink tank 5 to the reservoir tank 4 via the air introduction path 10 due to increase of an internal pressure. As described above, the standing wall 42 with the cylindrical shape surrounding the second hollow tube 9 in a circumferential direction is disposed on the bottom of the ink tank 5, and thus it is difficult for a portion of the high concentration ink layer 5*a* on the outside of the standing wall 42 flows into the reservoir tank 4 through the second hollow tube 9 (the air introduction path 10). In this regard, a portion of the high concentration ink layer 5*a* within the standing wall 42 has a small amount and does not cause a significant impact on the concentration in the reservoir tank 4 when flowing into the reservoir tank 4.

(2-3) Others

Ink supply (replenishment) to the reservoir tank 4 after the stirring of the ink tank 5 is described below.

As described above, after stirring of the ink in the reservoir tank 4 is finished, the stirring operation of the ink tank 5 can be performed while performing the recording operation. In this case, the ink in the reservoir tank 4 is consumed, so that it is necessary to supply (replenish) ink from the ink tank 5 to the reservoir tank 4 after the ink stirring operation of the ink tank 5 is finished.

As an ink supply method, the first on-off valve 31 and the second on-off valve 32 are opened, so that air is introduced to the ink tank 5 via the air introduction path 10, and also the ink is automatically supplied (replenished) from the ink tank 5 to the reservoir tank 4. (i.e., the bird feed supply system)

An ink supply amount (supply rate) of the bird feed supply system needs to be equal to or more than an ink usage (usage rate) used in the recording operation. According to the present exemplary embodiment, the ink supply amount (the supply rate) is determined by a "height difference (water head difference)" between an ink liquid surface (namely, a height position of an end surface of the opening 10*c* on a lower end surface of the air introduction path 10) in the reservoir tank 4 and a lower end surface 9*a* of the second hollow tube 9 (see FIG. 2). The height difference can be appropriately set according to the ink usage, however, according to the present exemplary embodiment, the height difference is set to about 20 mm.

Next, a stirring time length (number of stirring times) is described.

The stirring time length (or the number of stirring times) can be appropriately set according to a leaving period, an environment temperature, types of ink, and the like. For example, according to the present exemplary embodiment, the stirring time length (the number of stirring times) is set in three cases corresponding to the leaving period.

More specifically, according to the present exemplary embodiment, if the leaving period is within 10 days, the stirring operation is executed for about 15 seconds in the reservoir tank and for about 30 seconds in the ink tank. Whereas if the leaving period is 10 days or more and less than 20 days, the stirring operation is executed for about 30 seconds in the reservoir tank and for about 1 minute and 30 seconds in the ink tank. Further, if the leaving period is 20 days or more, the stirring operation is executed for about 1 minute in the reservoir tank and for about 3 minutes in the ink tank. According to the present exemplary embodiment, the volume change in the flexible unit 33 includes one reduction deformation operation and one expansion deformation operation per about 1 second (in other words, the flexible unit performs a deformation operation in 1 Hz).

Next, the stirring operation after an attachment and detachment operation of the ink tank is described.

When the ink tank 5 is mounted and then filling of the reservoir tank 4 with ink is finished, the stirring operation can be performed on the ink tank 5. A mounting state (attachment and detachment) of the ink tank 5 is detected by the above-described ink tank mounting sensor 18 (see FIG. 3). The stirring operation of the ink tank 5 is similar to the above-described stirring operation of the ink tank (see FIG. 4C and FIGS. 6A to 6C). The stirring operation may be performed simultaneously or independently on the ink tanks of a plurality of colors.

As described above, according to the first exemplary embodiment of the present invention, the ink stirring mechanism creates a state in which ink cannot move from the ink supply path to the second ink tank and then performs the first stirring operation for stirring by moving the ink between the ink supply path and the first ink tank. In addition, the ink stirring mechanism creates a state in which ink cannot move from the ink supply path to the first ink tank and then performs the second stirring operation for stirring by moving the ink between the ink supply path and the second ink tank.

Accordingly, the first and the second ink tanks are independently stirred, and the ink concentrations in the first and the second ink tanks can be efficiently uniformed.

In addition, according to the present exemplary embodiment, a maximum change amount of the internal volume of the flexible unit can be set larger than a volume of the ink supply path. Accordingly, the ink can be stirred more efficiently.

In addition, according to the present exemplary embodiment, the ink stirring mechanism can perform the second stirring operation before the first stirring operation. Accordingly, the recording operation can be started when stirring of the reservoir tank 4 is complete, and thus it is beneficial to reduction of down-time.

Further, according to the present exemplary embodiment, volumes of the first ink tank and the second ink tank are different, so that the first stirring operation and the second stirring operation can be different operations according to the respective volumes. Accordingly, the ink stirring operation can be performed more efficiently.

If the recording apparatus 50 receives a recording instruction before the stirring operation of the reservoir tank 4 (the second stirring operation) is finished, the recording apparatus 50 can start the recording operation immediately after the completion of the stirring operation of the reservoir tank 4. In other words, the recording apparatus 50 may start the stirring operation of the ink tank 5 (the first stirring operation) during a period when performing the recording operation.

Alternatively, the recording apparatus 50 may perform the recording operation and the first stirring operation at the same time. In other words, the recording apparatus 50 can perform the stirring operation of the ink tank 5 while performing the recording operation.

According to the present exemplary embodiment, the first hollow tube 8 and the second hollow tube 9 both are metal needles, however, the first hollow tube 8 and the second hollow tube 9 may be respectively formed as parts of the ink supply path 6 and the air introduction path 10. More specifically, one end of the ink supply path 6 may be connected to the bottom of the ink tank 5 and the other end thereof may be connected to the bottom of the reservoir tank. In addition, one end of the air introduction path 10 may be connected to the bottom of the ink tank 5 and the other end thereof may be connected to the upper portion of the reservoir tank 4.

According to the present exemplary embodiment, the detection unit 17 performs remaining amount detection (in other words, detection of the "full tank state" and the "empty state") of the reservoir tank 4 using the electrode 34, however, the detection unit 17 may adopt a different sensor in addition to the electrode. For example, float-type sensors, optical sensors, and other sensors may be adopted.

According to the present exemplary embodiment, the detection of the "empty state" of the ink tank 5 is indirectly performed by the sensor for detecting the "full tank state" of the reservoir tank 4, however, a dedicated sensor may be installed in the ink tank 5.

According to the present exemplary embodiment, the detection of the "empty state" of the reservoir tank 4 is performed by a system using the electrode 34. In this regard, the electrode 34 may detects only a full tank position (state) of the reservoir tank 4, and a dot counting system detection unit may be adopted which counts the number of discharges from the head 1 after detecting that the liquid surface becomes lower than the full tank position.

According to the present exemplary embodiment, the ink supply to the head 1 is performed by the water head difference system, however, a pump (not illustrated) may be installed between the reservoir tank 4 and the head 1, and the ink may be pressurized to be sent from the reservoir tank 4 to the head 1 side.

According to the present exemplary embodiment, the opening and closing unit is configured with the on-off valve, however, the opening and closing unit may be any openable and closable configuration without limiting to the on-off valve. For example, the opening and closing unit may be configured with a pump which can interrupt the flow path when the driving is stopped or a flexible unit which can switch between the open state and the close state.

An ink jet recording apparatus according to a second exemplary embodiment of the present invention is described below with reference to FIG. 7.

Figure 7:
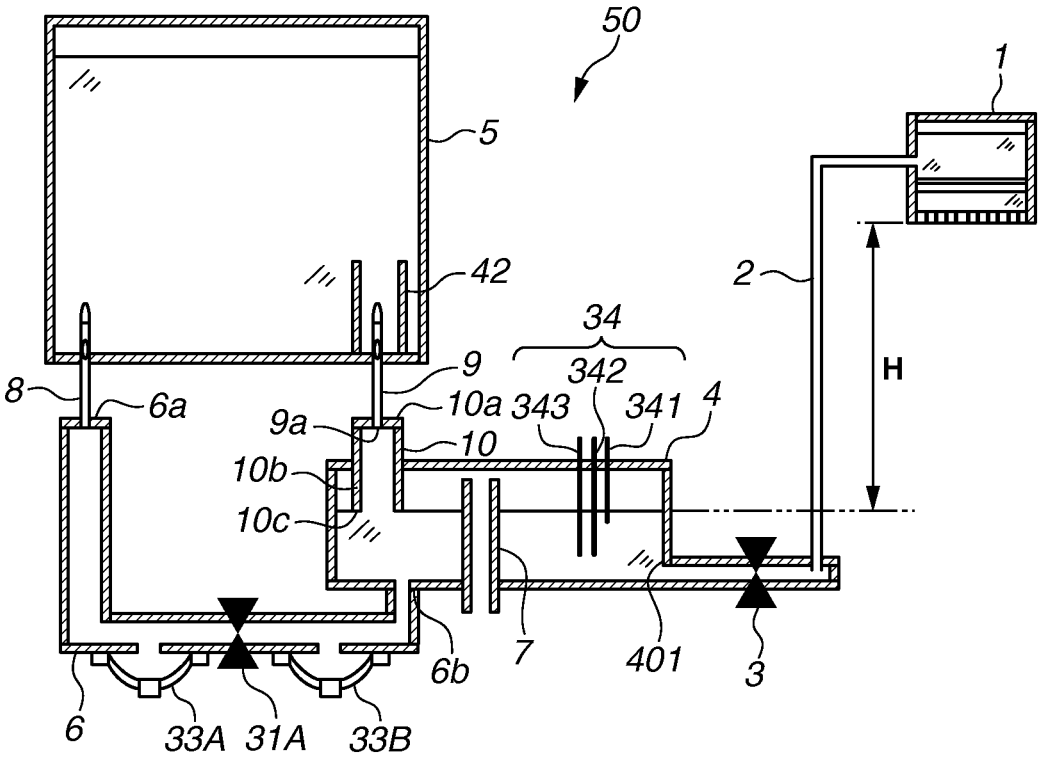
FIG. 7 is a schematic diagram illustrating ink flow paths of an ink jet recording apparatus according to a second exemplary embodiment of the present invention.

FIG. 7 is a schematic diagram illustrating ink flow paths of the ink jet recording apparatus according to the second exemplary embodiment of the present invention. As illustrated in FIG. 7, according to the present exemplary embodiment, the ink stirring mechanism includes an on-off valve 31A (an opening and closing unit), a first flexible unit 33A, and a second flexible unit 33B which are disposed on the ink supply path 6.

More specifically, the first flexible unit 33A is disposed between the on-off valve 31A and the ink tank 5. The second flexible unit 33B is disposed between the on-off valve 31A and the reservoir tank 4. In addition, the on-off valve 31A, the first flexible unit 33A, and the second flexible unit 33B are driven by a common driving mechanism (not illustrated).

The ink stirring mechanism brings the on-off valve 31A into the close state, then performs the first stirring operation by changing the internal volume of the first flexible unit 33A, and thus can independently stir the ink in the ink tank 5 (the first ink tank).

In addition, the ink stirring mechanism performs the second stirring operation by changing the internal volume of the second flexible unit 33B while the on-off valve 31A is closed, and thus can independently stir the ink in the reservoir tank 4 (the second ink tank).

As described above, according to the second exemplary embodiment, the first and the second ink tanks are independently stirred as in the case of the first exemplary embodiment, so that the ink concentrations in the first and the second ink tanks can be efficiently uniformed.

An ink jet recording apparatus according to a third exemplary embodiment of the present invention is described below with reference to FIG. 8.

Figure 8:
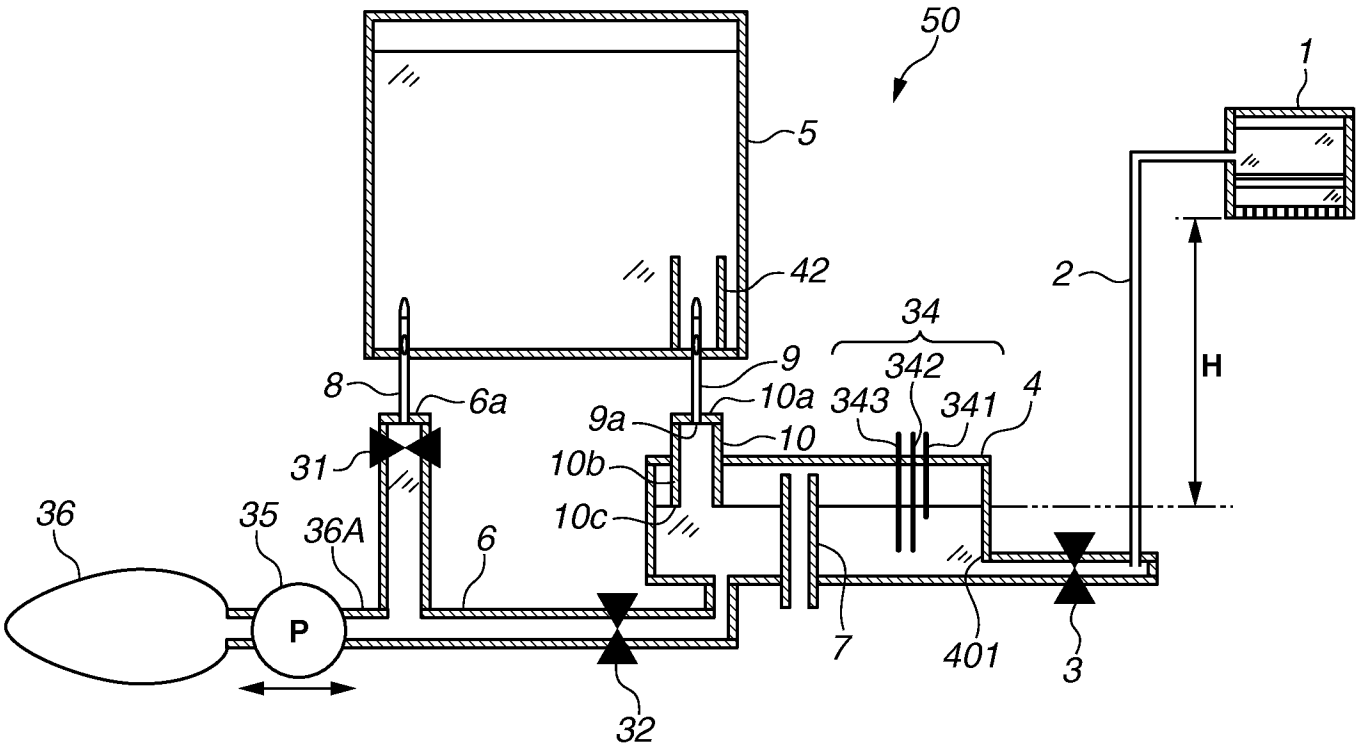
FIG. 8 is a schematic diagram illustrating ink flow paths of an ink jet recording apparatus according to a third exemplary embodiment of the present invention.

FIG. 8 is a schematic diagram illustrating ink flow paths of the ink jet recording apparatus according to the third exemplary embodiment of the present invention. As illustrated in FIG. 8, according to the present exemplary embodiment, the ink stirring mechanism includes the first on-off valve 31 (the first opening and closing unit), the second on-off valve 32 (the second opening and closing unit), a pump 35 (a supply unit), an ink storage unit 36, and a connection flow path 36A which are disposed on the ink supply path 6.

More specifically, the ink storage unit 36 is connected to the ink supply path 6 via the connection flow path 36A and can temporarily store the ink flowing from the ink supply path 6. The ink storage unit 36 is configured with members which have flexibility and can change an internal volume of its own.

The pump 35 is disposed on the connection flow path 36A and configured to be able to supply ink in the flow path along a first direction and a second direction which is opposite to the first direction.

The ink stirring mechanism brings the second on-off valve 32 into the close state, then performs the first stirring operation by the supply unit 35, and thus can independently stir the ink in the ink tank 5 (the first ink tank).

In addition, the ink stirring mechanism brings the first on-off valve 31 into the close state, then performs the second stirring operation by the supply unit 35, and thus can independently stir the ink in the reservoir tank 4 (the second ink tank).

According to the present exemplary embodiment, the stirring time length (the number of stirring times) can also be set in three cases corresponding to the leaving period.

More specifically, according to the present exemplary embodiment, if the leaving period is within 10 days, the stirring operation is executed for about 10 seconds in the reservoir tank and for about 20 seconds in the ink tank. Whereas if the leaving period is 10 days or more and less than 20 days, the stirring operation is executed for about 20 seconds in the reservoir tank and for about 1 minute in the ink tank. Further, if the leaving period is 20 days or more, the stirring operation is executed for about 30 seconds in the reservoir tank and for about 2 minutes in the ink tank. According to the present exemplary embodiment, the pump 35 controls a bidirectional operation for causing the ink to flow out and flow into at an interval of about 2 to 3 seconds.

As described above, according to the third exemplary embodiment, the first and the second ink tanks are independently stirred as in the case of the first exemplary embodiment, so that the ink concentrations in the first and the second ink tanks can be efficiently uniformed.

The ink storage unit 36 according to the present exemplary embodiment may be configured to cause the ink to flow into or out from the ink tank 5 or the reservoir tank 4 by the volume change in the ink storage unit 36.

In addition, inflow and outflow amounts of the ink is determined by a variable volume of the ink storage unit 36, and according to the present exemplary embodiment, for example, a variable volume of the ink storage unit 36 can be set to 5 ml. In this case, compared to a variable volume (0.7 to 1 ml) of the flexible unit 33 according to the first exemplary embodiment, a movable ink amount per deformation operation is larger, and thus a more remarkable stirring effect can be expected according to the present exemplary embodiment. In addition, reduction in the stirring time length can be expected.

An ink jet recording apparatus according to a fourth exemplary embodiment of the present invention is described below with reference to FIG. 9 to FIGS. 11A to 11C.

Figure 9:
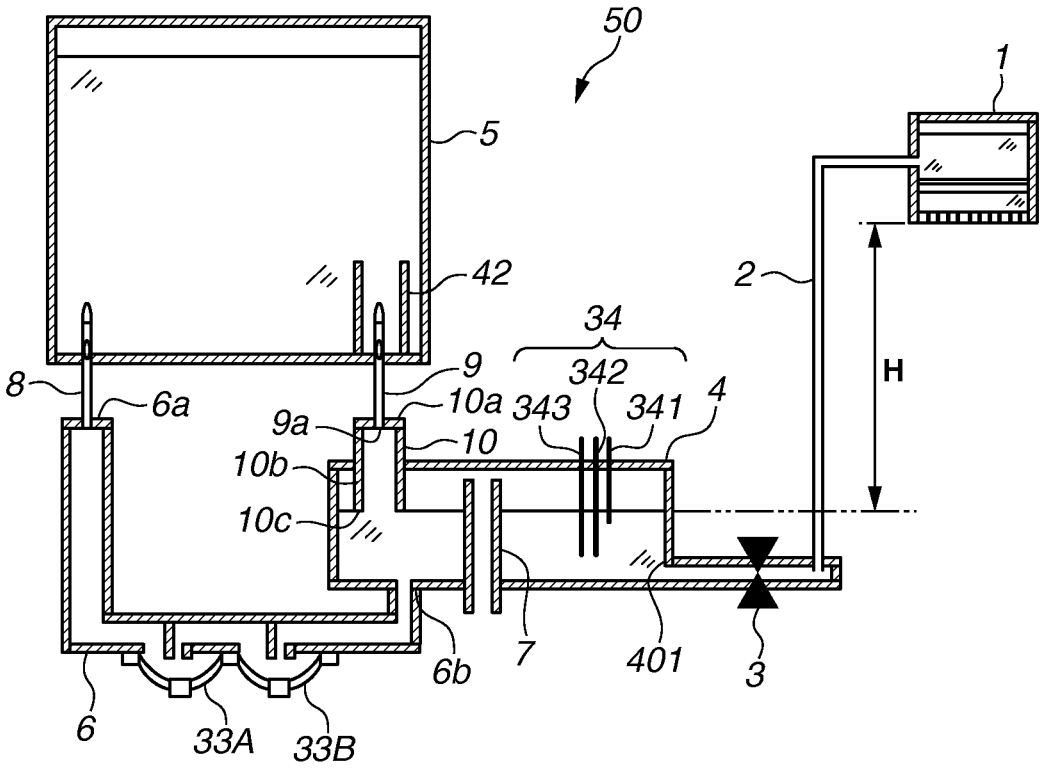
FIG. 9 is a schematic diagram illustrating ink flow paths of an ink jet recording apparatus according to a fourth exemplary embodiment of the present invention.
Figure 10A:
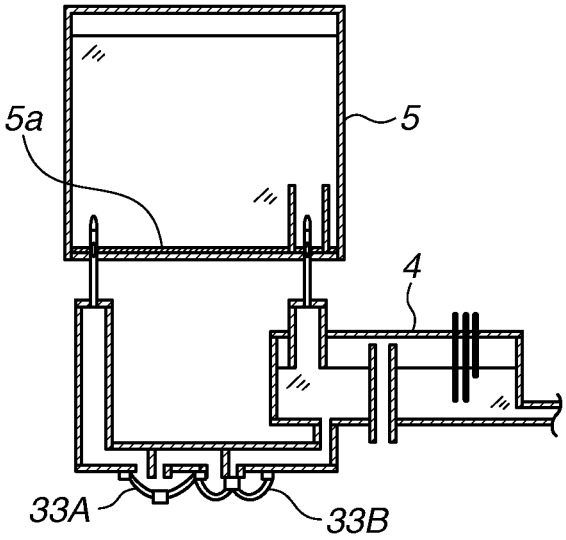
FIGS. 10A to 10C are schematic diagrams illustrating ink stirring operations in an ink tank according to the fourth exemplary embodiment.
Figure 10B:
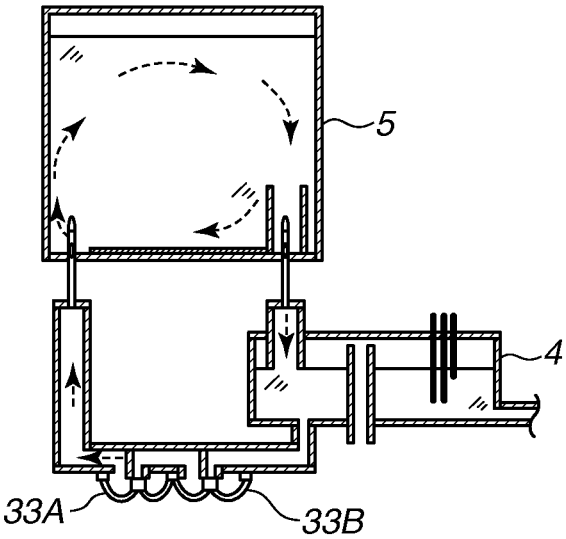
Figure 10C:
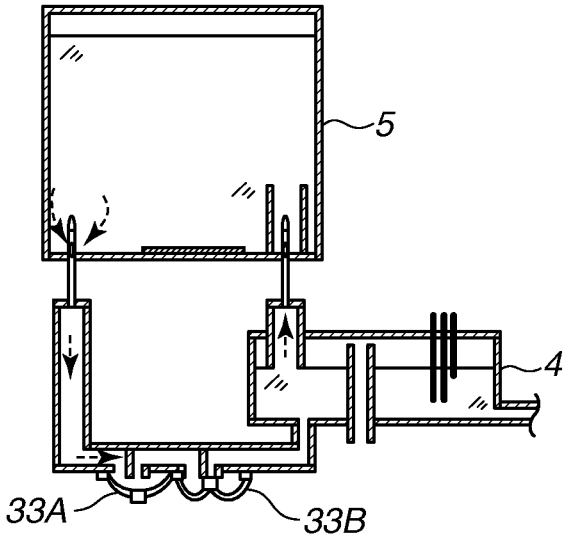
Figure 11A:
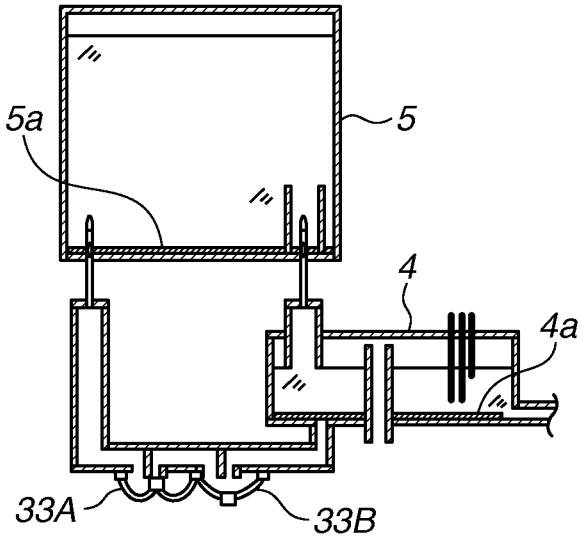
FIGS. 11A to 11C are schematic diagrams illustrating ink stirring operations in a reservoir tank according to the fourth exemplary embodiment.
Figure 11B:
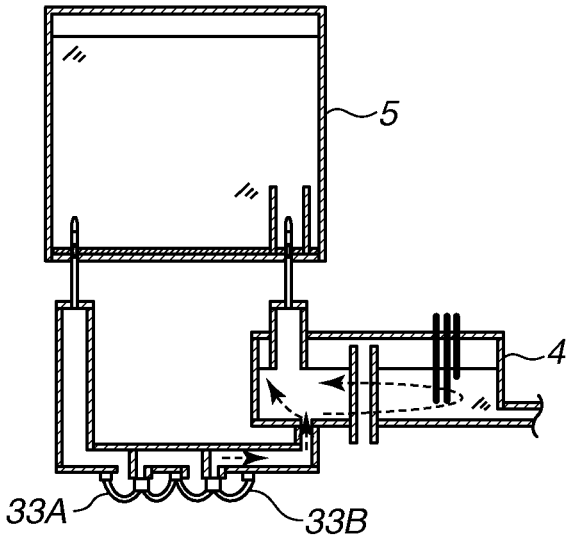
Figure 11C:
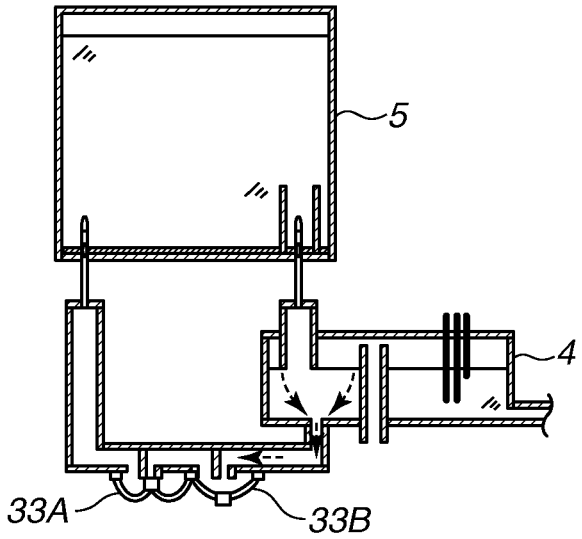
Figure 12A:
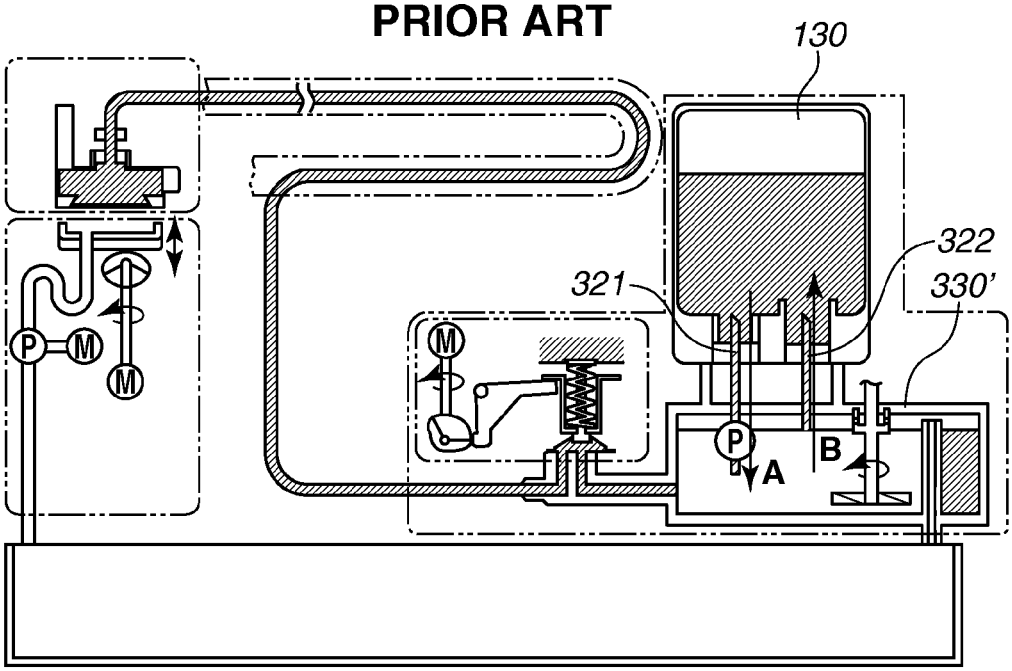
FIG.12A PRIOR ART
FIG. 12A illustrates ink flow paths of a conventional ink jet recording apparatus.
Figure 12B:
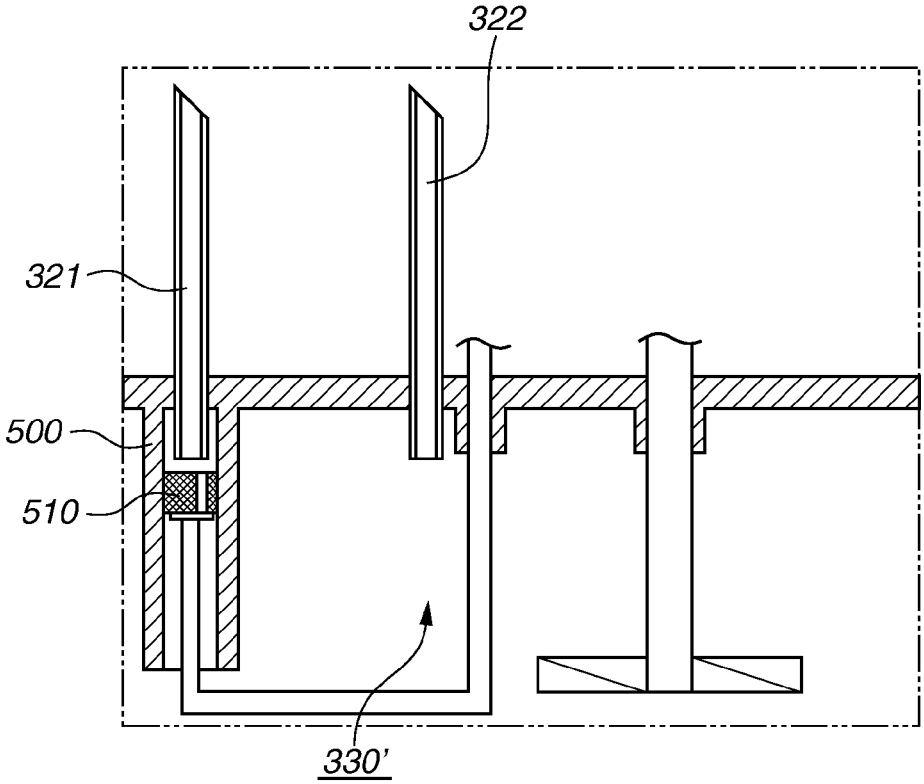
FIG.12B PRIOR ART
FIG. 12B is a required part enlarged view of the ink flow path of the conventional ink jet recording apparatus.

FIG. 9 is a schematic diagram illustrating ink flow paths of the ink jet recording apparatus according to the fourth exemplary embodiment of the present invention. FIGS. 10A to 10C are schematic diagrams illustrating ink stirring operations in the ink tank according to the fourth exemplary embodiment. FIGS. 11A to 11C are schematic diagrams illustrating ink stirring operations in the reservoir tank according to the fourth exemplary embodiment.

As illustrated in FIG. 9, according to the present exemplary embodiment, the ink stirring mechanism includes the first flexible unit 33A and the second flexible unit 33B which are disposed on the ink supply path 6.

The first flexible unit 33A and the second flexible unit 33B have a configuration similar to the flexible unit 33 according to the first exemplary embodiment and disposed on the ink supply path 6 in series. The variable volumes of the first and the second flexible units 33A and 33B are set to 0.7 to 1 ml similar to the flexible unit 33 according to the first exemplary embodiment.

As illustrated in FIGS. 10A to 10C, the ink stirring mechanism brings the ink supply path 6 into the close state by the second flexible unit 33B and then performs the first stirring operation by changing the internal volume of the first flexible unit 33A. Accordingly, the ink stirring mechanism can independently stir the ink in the ink tank 5 (the first ink tank).

In addition, as illustrated in FIGS. 11A to 11C, the ink stirring mechanism brings the ink supply path 6 into the close state by the first flexible unit 33A and then performs the second stirring operation by changing the internal volume of the second flexible unit 33B. Accordingly, the ink stirring mechanism can independently stir the ink in the reservoir tank 4 (the second ink tank).

According to the present exemplary embodiment, an example is described in which the second stirring operation is performed after the first stirring operation, however, the second stirring operation may be performed before the first stirring operation as in the case of the first exemplary embodiment.

According to the present invention as described above in the first to the fourth exemplary embodiments, the first and the second ink tanks are independently stirred by the ink stirring mechanism, so that the ink concentrations in the first and the second ink tanks can be efficiently uniformed.

In other words, mutual influence between the first and the second ink tanks at the time of stirring can be eliminated, and high stirring efficiency can be obtained.

When the first ink tank is stirred, pressure dispersion is eliminated by blocking pressure transmission to the second ink tank. Pressure generated by the stirring operation of the ink stirring mechanism is concentrated on ink in a single ink tank, so that the stirring effect is enhanced. Accordingly, the inks in the first and the second ink tanks can be efficiently stirred without increasing a size of the second ink tank. Thus, the ink stirring efficiency can be improved and the stirring time length can be shortened while suppressing the down-time of the ink supply apparatus or the ink jet recording apparatus.

According to the present invention, the inks in the ink tank and the reservoir tank can be efficiently stirred regardless of a size of the reservoir tank. In addition, when a volume and an operation rate of the ink stirring mechanism are increased, the present invention can be applied to a larger ink tank or a larger reservoir tank.

According to the present invention, the ink in the ink tank can be stirred while performing the recording operation after the stirring operation of the reservoir tank, so that the down-time can be further reduced. In addition, the ink jet recording apparatus according to the present invention does not include a piston mechanism and thus is free from dust generated by sliding of a sliding unit, so that deterioration in the ink quality can be prevented.

The ink supply apparatus or the ink jet recording apparatus according to the first to the fourth exemplary embodiments of the present invention, the first and the second ink tanks are independently stirred by the ink stirring mechanism, so that the ink concentrations in the first and the second ink tanks can be efficiently uniformed.

A fifth exemplary embodiment of the present invention is described below with reference to FIG. 13 to FIGS. 16A to 16D.

According to the present exemplary embodiment, a serial type ink jet recording apparatus is described as an example of an ink jet recording apparatus. In addition, an ink supply apparatus is a part of the ink jet recording apparatus.

1. Ink Jet Recording Apparatus (1-1) General Arrangement of Ink Jet Recording Apparatus The basic configuration of the ink jet recording apparatus according to the fifth exemplary embodiment of the present invention is basically similar to that of the first exemplary embodiment (see FIG. 1).

In other words, as illustrated in FIG. 1, the ink jet recording apparatus 50 (hereinbelow, simply referred to as the "recording apparatus") is fixed to extend over upper ends of two leg portions 55 facing each other. The carriage 60 is provided with the head 1 (the recording head).

When recording is performed, a recording medium set in the conveyance roll holder unit 52 is fed (conveyed) to the recording position. The carriage 60 is reciprocated in the main scanning direction B-B by the carriage motor (not illustrated) and the belt transmission unit 62, and ink droplets are discharged from each nozzle in the head 1. When the carriage 60 moves to one end of the recording medium, the conveyance roller 51 conveys the recording medium for the predetermined amount to the sub-scanning direction A.

The recording operation and the conveyance operation are alternately repeated as described above, and thus an image is formed on the entire recording medium. After image formation, the recording medium is cut by the cutter (not illustrated), and the cut recording medium is stacked on the stacker 53.

The ink supply unit 63 is provided with the ink tanks 5 (the first ink tanks) which are separated by ink colors, such as black, cyan, magenta, and yellow, and the respective color inks are stored therein. The ink tank 5 is connected to the supply tube 2 (the ink flow path) via the reservoir tank 4 (the second ink tank), which is described below. The supply tube 2 (the ink flow path) is bound with the tube guide 61 so as not to be an obstacle in the reciprocation movement of the carriage 60.

On the surface of the head 1 facing the recording medium, a plurality of nozzle rows (not illustrated) is provided in the direction approximately orthogonal to the main scanning direction B-B and connected to the supply tube 2 (the ink flow path) per nozzle row.

The recovery unit 70 is disposed on the position which is out of the area of the recording medium in the main scanning direction B-B and faces the nozzle surface of the head 1. The recovery unit 70 includes the suction unit which sucks ink or air from the discharge port surface of the head 1 to clean nozzles and forcibly sucks air stored in the head as necessary.

The operation panel 54 is disposed on the right side of the recording apparatus 50 (see FIG. 1), and a user can input an instruction to the recording apparatus 50 therefrom. In addition, when the ink tank 5 becomes empty of ink, the operation panel 54 may display a warning to prompt a user to change the ink tank 5.

Figure 13:
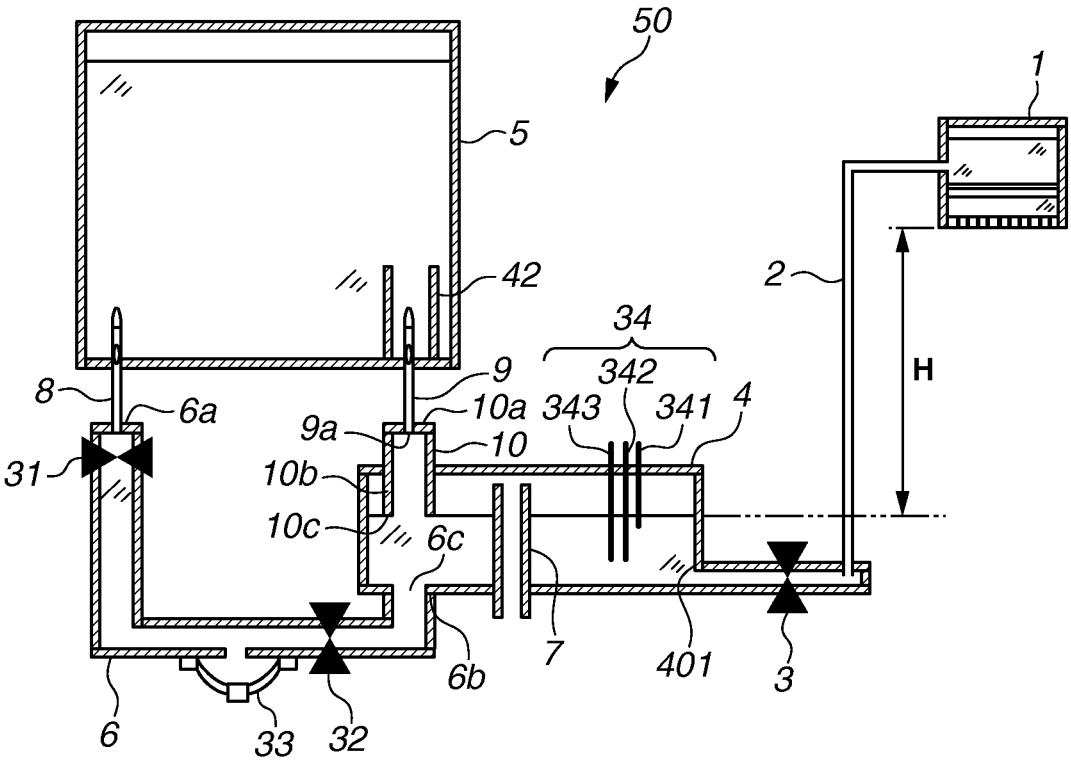
FIG. 13 is a schematic diagram illustrating ink flow paths of an ink jet recording apparatus according to a fifth exemplary embodiment of the present invention.

FIG. 13 is a schematic diagram illustrating ink flow paths of the ink jet recording apparatus according to the fifth exemplary embodiment. According to the present exemplary embodiment, the ink flow path for a single color is described as an example, however, the same can be applied to the ink flow paths for a plurality of colors.

As illustrated in FIG. 13, the recording apparatus 50 according to the present exemplary embodiment mainly includes the ink tank 5 for storing ink, the reservoir tank 4 for storing the ink supplied from the ink tank 5, and the head 1 for performing recording using the ink supplied from the reservoir tank 4.

The reservoir tank 4 is disposed below the ink tank 5. The ink supply path 6 (a first flow path) for supplying the ink from the ink tank 5 to the reservoir tank 4 and the air introduction path 10 (a second flow path) for introducing air from the reservoir tank 4 to the ink tank 5 are disposed between the ink tank 5 and the reservoir tank 4.

The reservoir tank 4 includes the atmosphere communication portion 7 for communicating with atmosphere and is opened to the atmosphere. On the other hand, the ink tank 5 does not include an atmosphere communication portion and is not opened to the atmosphere. The ink tank 5 is attachable to and detachable from the reservoir tank 4 (the apparatus main body).

The ink tank 5 has an inner space for storing ink and is provided with the two joint portions on the bottom. Into the joint portions, the first hollow tube 8 (the first flow path) and the second hollow tube 9 (the second flow path) described below can be inserted. Around the second hollow tube 9 inserted into the ink tank 5, the standing wall 42 with the cylindrical shape is disposed to stand on the bottom (the bottom surface) of the ink tank 5 so as to surround the second hollow tube 9.

One end 6*a* of the ink supply path 6 is connected to the first hollow tube 8, and the other end 6*b* thereof is connected to the bottom of the reservoir tank 4. In other words, the ink supply path 6 has an opening 6*c* (a first opening portion) which opens in the reservoir tank at the other end 6*b*. The ink supply path 6 and the first hollow tube 8 form the first flow path according to the present invention.

On the other hand, one end 10*a* of the air introduction path 10 is connected to the second hollow tube 9, and the other end 10*b* thereof is connected to the upper portion (the upper surface) of the reservoir tank 4. The other end 10*b* of the air introduction path 10 is inserted into the reservoir tank 4 from the upper surface of the reservoir tank 4 and has the opening 10*c* (a second opening portion). The air introduction path 10 and the second hollow tube 9 form the second flow path according to the present invention.

A position of the opening 6*c* of the ink supply path 6 is arranged lower than a position of the opening 10*c* of the air introduction path 10 in the reservoir tank 4. In other words, the second opening portion (the opening 10*c*) of the second flow path is arranged on a higher position than the first opening portion (the opening 6*c*) of the first flow path in the reservoir tank 4.

Therefore, when the ink is supplied from the ink tank 5 to the reservoir tank 4 through the ink supply path 6 (and the first hollow tube 8), air is introduced from the reservoir tank 4 to the ink tank 5 through the air introduction path 10 (and the second hollow tube 9) by the water head difference.

On the other hand, when the liquid surface in the reservoir tank 4 rises and fills the opening 10*c*, movement of the air from the reservoir tank 4 to the ink tank 5 is stopped, and the ink supply from the ink tank 5 to the reservoir tank 4 is also stopped.

As described above, when the ink in the reservoir tank 4 is consumed and the liquid surface is lowered, the air is introduced to the ink tank 5 through the air introduction path 10, and the ink is automatically supplied to the reservoir tank 4 (the bird feed supply system). Until the ink tank 5 becomes empty of ink therein, the ink liquid surface in the reservoir tank 4 is placed approximately at the same height of the opening 10*c* of the air introduction path 10.

The reservoir tank 4 is provided with the metal solid tubes 341 to 343 as the electrodes 34. The lower end of the first solid tube 341 is arranged slightly lower (about 4 mm below according to the present exemplary embodiment) than the opening 10*c* of the air introduction path 10. Accordingly, the full tank state of the reservoir tank 4 can be certainly detected. The second solid tube 342 and the third solid tube 343 have approximately the same length, and lower ends of them are both placed lower than the lower end of the first solid tube 341 and higher than the ink flow-out port 401 from the reservoir tank 4 to the head 1.

Accordingly, when a weak voltage is applied between the first solid tube 341 and the third solid tube 343, and if the ink in the reservoir tank 4 is in the full tank state, an electric current flows between the electrodes, and a resistance value between the two electrodes becomes lower. As described above, whether the reservoir tank 4 is in the "full tank state" or not can be detected based on a change in the resistance value between the electrodes.

Similarly, when a weak voltage is applied between the second solid tube 342 and the third solid tube 343, and if the ink liquid surface in the reservoir tank 4 is lower than the lower end of the electrode 34, an electric current does not flow between the two electrodes, and the resistance value therebetween becomes higher. As described above, whether the reservoir tank 4 is in the "empty state" or not can be detected based on a change in the resistance value between the electrodes.

As long as the ink is present in the ink tank 5, the reservoir tank 4 can be brought into the "full tank state" based on the bird feed supply system. Thus, when the electrode 34 detects that the ink in the reservoir tank 4 is not in the "full tank state", it can be estimated that the ink in the ink tank 5 is in the empty state. In other words, the electrode 34 can also detect the "empty state" of the ink tank 5.

According to the present exemplary embodiment, the ink flow-out port 401 is disposed on the lowest position on the side surface of the reservoir tank 4. In addition, the on-off valve 3 is disposed between the reservoir tank 4 and the supply tube 2. The on-off valve 3 is disposed, and thus "removal of air from the head and filling of ink into the head" described below can be smoothly performed.

According to the present exemplary embodiment, the on-off valve 3 is driven by the same driving source of the below-described ink stirring mechanism (a circulation mechanism), however, the on-off valve 3 may be driven by a different driving source. In addition, the on-off valves in the ink flow paths for a plurality of colors may be configured to be driven at the same time.

According to the present exemplary embodiment, the ink in the head 1 is maintained under a negative pressure by the water head difference H (see FIG. 13) between the ink liquid surface in the reservoir tank 4 and the discharge port surface of the head 1. According to the present exemplary embodiment, the water head difference H is about 80 mm.

When air is stored in the head 1, it is necessary to forcibly remove the air from the head. As a method for removing the air in the head, the head 1 is sucked by the recovery unit 70 (see FIG. 1) while the on-off valve 3 is closed.

More specifically, a cap (not illustrated) is tightly attached to the discharge port surface of the head 1, and air is sucked by driving a pump (not illustrated). The suction is performed for a predetermined time length (about 25 seconds according to the present exemplary embodiment), and the on-off valve 3 is opened, so that the head is filled with the ink. In other words, the on-off valve 3 is opened after the suction, and thus a predetermined amount of ink is sucked from the reservoir tank 4 to the head 1 by the negative pressure in the head. Accordingly, the head is filled with the ink. As the ink in the head 1 is consumed, the ink is supplied to the head 1 again in the order of the ink tank 5 and the reservoir tank 4.

(1-2) Control Mechanism of Ink Jet Recording Apparatus

The control mechanism of the ink jet recording apparatus according to the fifth exemplary embodiment is basically similar to that of the first exemplary embodiment (see FIG. 3).

In other words, as illustrated in FIG. 3, the recording apparatus 50 according to the present exemplary embodiment mainly includes the CPU 11 for controlling the recording apparatus and the user interface 12 including the operation panel for displaying keys to be operated by a user and information. The recording apparatus 50 further includes the ROM 13 incorporating control software and the RAM 14 temporarily used when the control software is operated. Furthermore, the recording apparatus 50 includes the driving unit I/O 15, the driving unit 16, the detection unit 17 for detecting an ink amount, and the ink tank mounting sensor 18 for detecting attachment and detachment of the ink tank.

According to the present exemplary embodiment, the detection unit 17 includes the electrode 34 and an electric circuit to be connected to the electrode 34 and detects liquid surface information in the reservoir tank 4 from a voltage value of the electrode 34. In addition, the detection unit 17 may include a configuration for detecting an ink amount in the ink tank 5.

The ink tank mounting sensor 18 determines the attachment and detachment state by a read value of the EEPROM attached to the ink tank 5. In addition, the ink tank mounting sensor 18 is used to read and write contents (recording information) in the EEPROM 20. In other words, every time the ink is used, the remaining amount in the ink tank 5 is recorded in the EEPROM 20, and the remaining amount management of the ink tank 5 is performed.

2. Ink Stirring Mechanism (Circulation Mechanism)

(2-1) Configuration of Ink Stirring Mechanism

The ink stirring mechanism (circulation mechanism) according to the present exemplary embodiment is described below.

The ink stirring mechanism is disposed on the ink supply path 6 and includes the first on-off valve 31 (the first opening and closing unit), the second on-off valve 32 (the second opening and closing unit), and the flexible unit 33 (a volume change unit). The first on-off valve 31 and the second on-off valve 32 are openable and closable.

More specifically, the flexible unit 33 is disposed on the first flow path and can change the internal volume thereof. When the internal volume is expanded, ink flows into the flexible unit 33 from the first flow path, and when the internal volume is reduced, ink flows out from the flexible unit 33 to the first flow path.

The first on-off valve 31 is disposed between the ink tank 5 and the flexible unit 33, and the second on-off valve 32 is disposed between the reservoir tank 4 and the flexible unit 33. The first on-off valve 31 and the second on-off valve 32 each are switched between the open state and the close state, so that the ink supply path 6 can be opened and closed.

According to the present exemplary embodiment, the flexible unit 33 is configured with flexible members which have flexibility and can change the internal volume. However, for the volume change unit, members are required only to be able to change the internal volume and not necessary to have flexibility. For example, the volume change unit may include a cylinder unit and a piston unit and change the internal volume of its own.

The flexible unit 33 is deformed to change the internal volume, so that the ink can flow in and out the flexible unit 33. According to the present exemplary embodiment, the first on-off valve 31, the second on-off valve 32, and the flexible unit 33 are driven by the common driving mechanism (not illustrated).

According to the present exemplary embodiment, the flexible unit 33 is disposed on the lowest part of the ink supply path 6 in the direction of gravity. Accordingly, the flexible unit 33 can efficiently move the ink with less air bubble incorporation. According to the present exemplary embodiment, a variable volume of the flexible unit 33 is set to about 0.7 to 1.5 ml. The arrangement and the internal volume of the flexible unit 33 can be appropriately changed to perform operations.

(2-2) Control of Ink Stirring Mechanism

According to the present exemplary embodiment, the stirring control of the ink stirring mechanism includes the stirring control of the reservoir tank (only) and the circulation control for stirring by circulating ink between the reservoir tank and the ink tank.

The circulation control is to perform an circulation operation including an operation (a first operation) for moving the ink from the ink supply path 6 to the ink tank 5 and an operation (a second operation) for moving the ink from the reservoir tank 4 to the ink supply path 6. In other words, when the ink is moved from the ink supply path 6 to the ink tank 5, the pressure in the ink tank 5 is increased, and the ink is moved (pushed out) from the ink tank 5 to the reservoir tank 4 through the air introduction path 10. The first operation and the second operation are repeated, and the ink is circulated and stirred between the ink tank 5 and the reservoir tank 4.

On the other hand, in the reservoir tank stirring control, the ink is reciprocated between the ink supply path 6 and the reservoir tank 4, and thus the ink in the reservoir tank is stirred.

According to the present exemplary embodiment, the stirring control of the ink stirring mechanism is performed when a predetermined time length has elapsed since the last stirring operation and when the ink tank 5 is changed. A time length to perform stirring can be changed according to the elapsed time. For example, as the elapsed time is longer, the stirring time length can be set longer.

The control of the ink stirring mechanism (the stirring operation) according to the present exemplary embodiment is described in detail below.

Figure 15A:
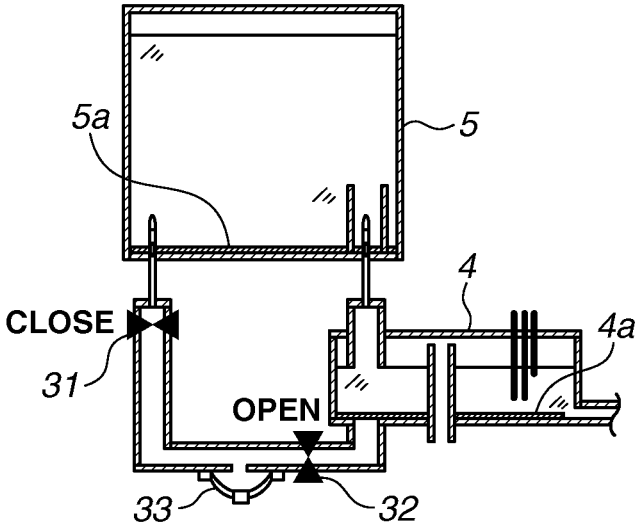
FIGS. 15A to 15C are schematic diagrams illustrating ink stirring operations in a reservoir tank according to the fifth exemplary embodiment.
Figure 15B:
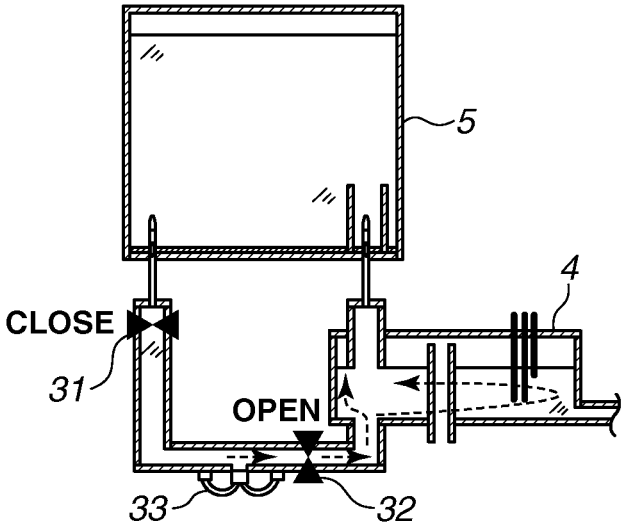
Figure 15C:
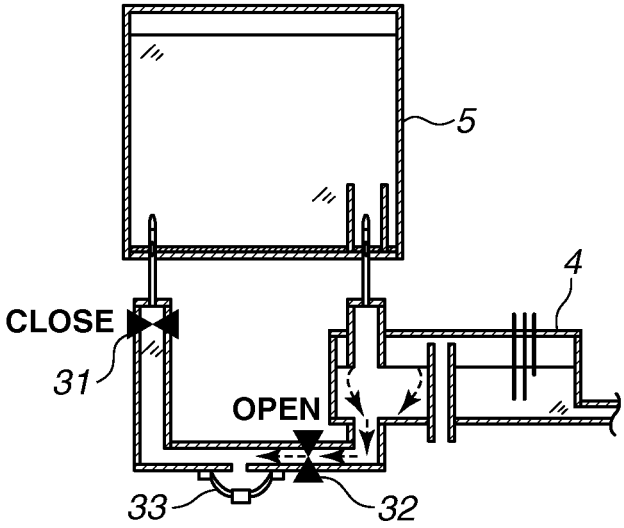

FIGS. 14A to 14C are flowcharts illustrating the ink stirring control according to the present exemplary embodiment. FIGS. 15A to 15C are schematic diagrams illustrating the ink stirring operations in the reservoir tank according to the present exemplary embodiment. Further, FIGS. 16A to 16D are schematic diagrams illustrating the ink stirring operations (the circulation operations) in the ink tank and the reservoir tank according to the present exemplary embodiment.

As illustrated in FIG. 15A, when time has passed while leaving the ink tank 5 and the reservoir tank 4 untouched, the precipitated high concentration ink layers 5*a* and 4*a* are respectively generated in the ink tank 5 and the reservoir tank 4.

When the stirring operation is required as in the above-described case, as illustrated in FIG. 14A, first in step S201, it is determined whether the ink tanks 5 of all colors are in the "empty state". As described above, the determination of the "empty state" of the ink tank 5 is estimated from that the reservoir tank 4 is not in the "full tank state". In other words, when the detection unit 17 detects that the reservoir tank 4 is not the "full tank state" (i.e., the OFF signal) based on an electric signal from the electrode 34 in the reservoir tank 4, it is determined that the ink tank 5 is in the "empty state".

In step S201, if it is determined that the ink tank 5 of any one color among the plurality of color inks is not in the "empty state" (NO in step S201), in step S202, it is determined whether the leaving period (the elapsed time from the last stirring operation) of the ink tank 5 is less than a predetermined time length (for example 10 days).

If the leaving period of the ink tank 5 is less than 10 days (YES in step S202), in step S203, the stirring operation is performed on the reservoir tank 4.

On the other hand, if the leaving period of the ink tank 5 is 10 days or more (NO in step S202), in step S206, the circulation operation (the stirring operation of the ink tank 5 and the reservoir tank 4) is performed. Subsequently, in step S207, the stirring operation is performed only on the reservoir tank 4.

When the stirring operation of the reservoir tank 4 is complete in step S203 or step S207, then in step S204, the circulation operation (the stirring operation of the ink tank 5 and the reservoir tank 4) is performed.

In other words, the stirring operation of the reservoir tank 4 can be performed before the circulation operation (the stirring operation of the ink tank 5 and the reservoir tank 4) when all of the ink tanks 5 are not in the "empty state" and the leaving period of the ink tank 5 is less than the predetermined time length (10 days).

Accordingly, the recording operation can be started at an early point when the stirring operation of the reservoir tank 4 (step S203) is finished which contributes to reduction of down-time. The circulation operation (the stirring operation of the ink tank 5 and the reservoir tank 4) may be performed while performing the recording operation. In other words, the recording operation and the circulation operation may be performed in parallel.

On the other hand, in step S201, when the ink tanks in the ink flow paths of the plurality of colors are all in the empty state (YES in step S201, in other words, the reservoir tank 4 is not the "full tank state" and the OFF signal), in step S205, the stirring operation is performed only on the reservoir tank 4.

The control of the stirring operation of the reservoir tank 4 is described in detail below with reference to FIG. 14B and FIGS. 15A to 15C. The control of the circulation and stirring operation (the stirring control of the ink tank 5 and the reservoir tank 4) is described in detail below with reference to FIG. 14C and FIGS. 16A to 16D.

(A) Stirring Control of Reservoir Tank

As illustrated in FIG. 14B, as a method for the stirring control only on the reservoir tank 4, first in step S301, the first on-off valve 31 is closed. (A state illustrated in FIG. 15A)

In step S302, the flexible unit 33 is reduced (in volume) and deformed. (A state illustrated in FIG. 15B)

As illustrated in FIG. 15B, a third operation is performed for reducing and deforming the flexible unit 33 while the second on-off valve 32 is opened and the first on-off valve 31 is closed. As a result, the ink is not pushed out from the ink supply path 6 to the ink tank 5 side, and the ink corresponding to a changed amount in the flexible unit 33 is pushed out to the reservoir tank 4 side.

Accordingly, a large flow of the ink is generated in the reservoir tank 4, and the precipitated high concentration ink layer 4*a* is raised and stirred.

Subsequently, in step S302, the flexible unit 33 is expanded (in volume) and deformed as illustrated in FIG. 15C, so that the ink in the reservoir tank 4 is drawn into the ink supply path 6 by the changed amount of the flexible unit 33.

As described above, in step S303, the volume change operation of the flexible unit 33 is executed for a plurality of times (N times) or a predetermined stirring time length while the first on-off valve 31 is closed and the second on-off valve 32 is opened.

As described above, the third operation illustrated in FIGS. 15A to 15C is repeatedly executed, and thus a large flow of the ink can be generated in the reservoir tank 4. Thus, the ink in the reservoir tank 4 can be effectively stirred, and the ink concentration in the reservoir tank 4 can be uniformed.

When the volume change operation is completed for the number of times (N times) (or the predetermined stirring time length) determined according to the elapsed (leaving) period (YES in step S303), in step S304, the first on-off valve 31 is opened, and the stirring control of the reservoir tank 4 (control of the third operation) is complete.

(B) Stirring Control (Circulation Control) of Ink Tank and Reservoir Tank

As illustrated in FIG. 14C, as a method of the stirring control for performing the stirring operation by circulating the ink between the ink tank 5 and the reservoir tank 4, in step S401, the second on-off valve 32 is closed, and then in step S402, the first on-off valve 31 is opened. (A state illustrated in FIG. 16A)

In step S403, the flexible unit 33 is reduced (in volume) and deformed. (A state illustrated in FIG. 16B)

Figure 16C:
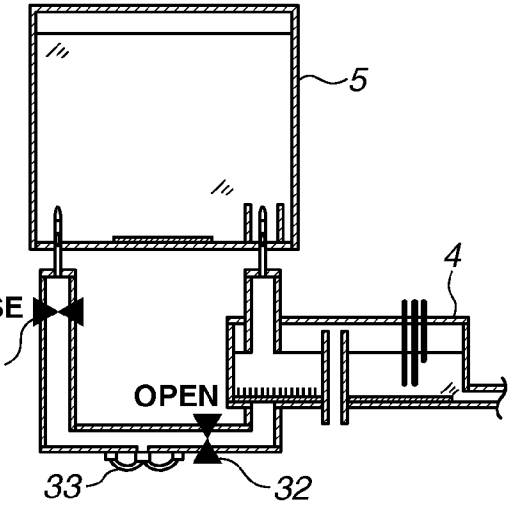
FIGS. 16A to 16D are schematic diagrams illustrating ink circulation operations in an ink tank and the reservoir tank according to the fifth exemplary embodiment.
Figure 16D:
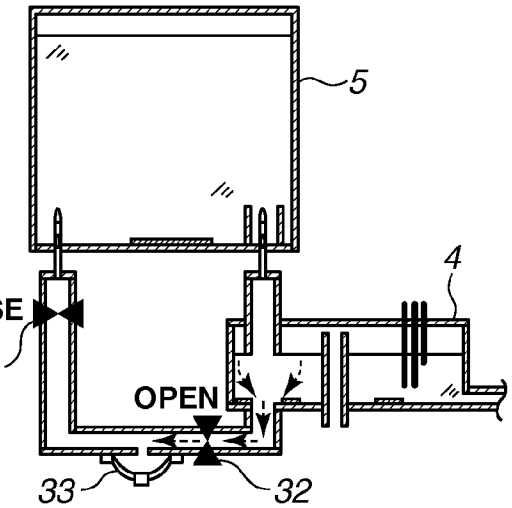
Figure 16A:
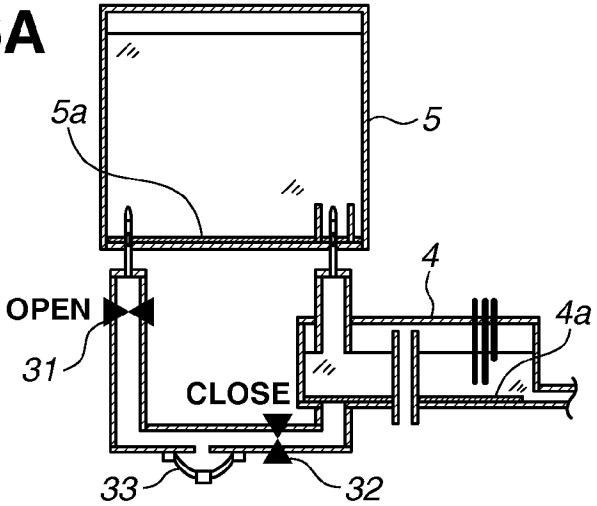
Figure 16B:
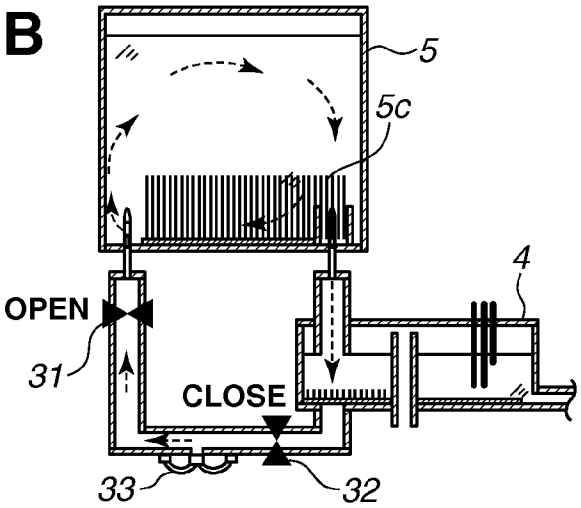

As illustrated in FIG. 16B, the first operation is performed for reducing and deforming the flexible unit 33 while the first on-off valve 31 is opened and the second on-off valve 32 is closed. As a result, the ink is not pushed out from the ink supply path 6 to the reservoir tank 4 side, and the ink corresponding to a changed amount in the flexible unit 33 is pushed out to the ink tank 5 side.

Accordingly, a large flow of the ink is generated in the ink tank 5, and the high concentration ink layer 5*a* precipitated near the bottom is raised and stirred. In other words, the high concentration ink layer 5*a* is slightly diluted with the ink (relatively low concentration) flowing into the ink tank 5, and a slightly high concentration ink layer 5*c* is formed near the bottom.

In addition, the ink flows into the ink tank 5 through the ink supply path 6, and thus the pressure in the ink tank 5 is increased. Therefore, a portion of the relatively high concentration ink (5*a* or 5*c*) present in the lower part of the ink tank 5 flows into the reservoir tank 4 through the second hollow tube 9 (and the air introduction path 10).

In step S403, the flexible unit 33 is reduced and deformed, then in step S404, the first on-off valve 31 is closed, and in step S405, the second on-off valve 32 is opened as illustrated in FIG. 16C. Then in step S406, the flexible unit 33 is expanded (in volume) and deformed as illustrated in FIG. 16D.

As illustrated in FIG. 16D, when the second operation is performed for expanding and deforming the flexible unit while the first on-off valve 31 is closed and the second on-off valve 32 is opened, the (relatively high concentration) ink near the bottom of the reservoir tank 4 is drawn into the ink supply path 6 by the changed amount of the flexible unit 33.

As described above, in step S407, the volume change operation of the flexible unit 33 is executed for a plurality of times (N times) or a predetermined stirring time length in response to the open and close operations of the first and the second on-off valves 31 and 32.

As illustrated in FIG. 16A to 16D, the circulation operation is executed by alternately repeating the first operation and the second operation, and thus a large flow of the ink can be generated in the ink tank 5. Accordingly, the ink in the ink tank 5 can be effectively stirred, and the ink concentrations in the ink tank 5 and the reservoir tank 4 can be uniformed.

When the volume change operation (the circulation operation) is completed for the number of times (N times) (or the predetermined stirring time length) determined according to the elapsed (leaving) period and a remaining ink amount in the ink tank (YES in step S407), in step S408, the first on-off valve 31 is opened, and the stirring control of the ink tank 5 (the circulation control) is complete.

According to the present exemplary embodiment, when the circulation operation is performed, the second on-off valve 32 is closed in step S401, the first on-off valve is opened in step S402, and the flexible unit 33 is reduced and deformed in this state in step S403, so that the ink is pushed out from the ink supply path 6 to the ink tank 5 (the first operation). Subsequently, the first on-off valve is closed in step S404, the second on-off valve is opened in step S405, and the flexible unit 33 is expanded and deformed in this state in step S406, so that the ink is drawn from the reservoir tank 4 into the ink supply path 6 (the second operation). These operations are alternately performed, and the ink is circulated and moved between the ink tank 5 and the reservoir tank 4.

The circulation operation may be performed in reverse order to the above-described order. In other words, the flexible unit 33 may be expanded and deformed in the state in which the first on-off valve 31 is closed and the second on-off valve 32 is opened, so that the ink is drawn from the reservoir tank 4 into the ink supply path 6 (the second operation). Subsequently, the flexible unit 33 may be reduced and deformed in the state in which the second on-off valve 32 is closed and the first on-off valve 31 is opened, so that the ink is pushed out from the ink supply path 6 to the ink tank 5 (the first operation). Similarly, these operations are alternately performed, and thus the ink is circulated and moved between the ink tank 5 and the reservoir tank 4.

According to the present exemplary embodiment, pressurization (reduction deformation) of the flexible unit 33 causes the ink to move from the reservoir tank 4 to the ink tank 5 through the ink supply path 6. Accordingly, the ink tank 5 is in the pressurized state, and the ink is moved from the ink tank 5 to the reservoir tank 4 through the air introduction path 10. Since the air introduction path 10 is opened at the bottom of the ink tank 5, the high concentration ink (5*a* or 5*c*) near the bottom flows into the reservoir tank 4.

In order to efficiently move (circulate) the high concentration ink flowing into the reservoir tank 4 to the ink tank 5, it is desirable that the opening of the ink supply path 6 in the reservoir tank 4 is disposed near a position immediately below the opening of the air introduction path 10.

That is to say, it is desirable that the opening 6*c* is disposed near the opening 10*c* when viewed along the vertical direction. In other words, it is desirable that a distance between respective centers of the opening 10*c* and the opening 6*c* is set to a predetermined value or less (for example, 5 cm or less).

If the opening 10*c* and the opening 6*c* are arranged so as to overlap with each other (immediately below) viewed from the vertical direction, the ink is more efficiently moved to the ink supply path 6 and circulated. Thus, the relatively high concentration ink (5*a* or 5*c*) flowing (falling) in the reservoir tank 4 through the opening 10*c* can be mixed with the high concentration ink 4*a* near the bottom of the reservoir tank 4 and quickly moved to the ink supply path 6.

As described above, the circulation mechanism according to the present invention can improve the ink stirring efficiency in the ink tank 5 and the reservoir tank 4 and also enhance uniformity of the ink concentrations in the ink tank 5 and the reservoir tank 4.

In addition, the circulation mechanism according to the present invention can maintain sufficient stirring performance if a size of the ink tank is increased and shorten a preparation time (down-time) before starting the recording operation. Since the stirring efficiency can be improved without increasing the volume of the reservoir tank, it is advantageous for miniaturization of the apparatus.

In addition, a strength of an ink flow in the ink tank or the reservoir tank can be controlled by an amount and a flow rate of the ink flowing into the ink tank 5 or the reservoir tank 4. On the other hand, the ink amount and the flow rate is controlled by a volume change amount and a change rate of the flexible unit 33. Therefore, when the flexible unit 33 is controlled, the operation of the reservoir tank or the circulation operation of the ink tank and the reservoir tank can be independently controlled.

3. Others

Ink supply (replenishment) to the reservoir tank 4 after the stirring of the ink tank 5 is described below.

As described above, after stirring of the ink in the reservoir tank 4 is finished, the stirring operation of the ink tank 5 can be performed while performing the recording operation. In this case, the ink in the reservoir tank 4 is consumed, so that it is necessary to supply (replenish) ink from the ink tank 5 to the reservoir tank 4 after the ink stirring operation of the ink tank 5 is finished.

As the ink supply method, the first on-off valve 31 and the second on-off valve 32 are opened, so that air is introduced to the ink tank 5 via the air introduction path 10, and also the ink is automatically supplied (replenished) from the ink tank 5 to the reservoir tank 4. (i.e., the bird feed supply system)

The ink supply amount (supply rate) of the bird feed supply system needs to be equal to or more than an ink usage (usage rate) used in the recording operation. According to the present exemplary embodiment, the ink supply amount (the supply rate) is determined by the "height difference (water head difference)" between the ink liquid surface (in other words, the height position of the end surface of the opening 10*c* on the lower end surface of the air introduction path 10) in the reservoir tank 4 and the lower end surface 9*a* of the second hollow tube 9 (see FIG. 13). The height difference can be appropriately set according to the ink usage, however, according to the present exemplary embodiment, the height difference is set to about 20 mm.

Next, a stirring time length (number of stirring times) is described.

The stirring time length (or the number of stirring times) can be appropriately set according to a leaving period, a remaining ink amount in the ink tank, an environment temperature, types of ink, and the like. For example, according to the present exemplary embodiment, the stirring time length (the number of stirring times) is set in three cases corresponding to the leaving period.

More specifically, according to the present exemplary embodiment, if the leaving period is less than 10 days, the stirring control (the stirring operation) of the reservoir tank is executed for about 15 seconds, and the stirring control (the circulation operation) of the ink tank and the reservoir tank is executed for about 30 second. Whereas if the leaving period is 10 days or more and less than 20 days, the stirring control (the stirring operation) of the reservoir tank is executed for about 30 seconds, and the stirring control (the circulation operation) of the ink tank and the reservoir tank is executed for about 1 minute and 30 seconds. Further, if the leaving period is 20 days or more, the stirring control (the stirring operation) of the reservoir tank is executed for about 1 minute, and the stirring control (the circulation operation) of the ink tank and the reservoir tank is executed for about 3 minutes. According to the present exemplary embodiment, the volume change in the flexible unit 33 includes one reduction deformation operation and one expansion deformation operation per about 1 second (in other words, the flexible unit performs a deformation operation in 1 Hz).

Next, the stirring operation after the attachment and detachment operation of the ink tank is described.

When the ink tank 5 is mounted and then filling of the reservoir tank 4 with ink is finished, the stirring operation can be performed on the ink tank 5. The mounting state (attachment and detachment) of the ink tank 5 is detected by the above-described ink tank mounting sensor 18 (see FIG. 3). The stirring operation of the ink tank 5 is similar to the above-described stirring operation of the ink tank (see FIG. 14C and FIGS. 16A to 16D). The stirring operation may be performed simultaneously or independently on the ink tanks of a plurality of colors.

In addition, according to the present exemplary embodiment, the maximum change amount of the internal volume of the flexible unit can be set larger than a volume of the ink supply path. Accordingly, the ink can be stirred more efficiently.

According to the present exemplary embodiment, the first hollow tube 8 and the second hollow tube 9 both are metal needles, however, the first hollow tube 8 and the second hollow tube 9 may be respectively formed as parts of the ink supply path 6 and the air introduction path 10. More specifically, one end of the ink supply path 6 may be connected to the bottom of the ink tank 5 and the other end thereof may be connected to the bottom of the reservoir tank. In addition, one end of the air introduction path 10 may be connected to the bottom of the ink tank 5 and the other end thereof may be connected to the upper portion of the reservoir tank 4.

According to the present exemplary embodiment, the detection unit 17 performs the remaining amount detection (in other words, detection of the "full tank state" and the "empty state") of the reservoir tank 4 using the electrode 34, however, the detection unit 17 may adopt a different sensor in addition to the electrode. For example, float-type sensors, optical sensors, and other sensors may be adopted.

According to the present exemplary embodiment, the detection of the "empty state" of the ink tank 5 is indirectly performed by the sensor for detecting the "full tank state" of the reservoir tank 4, however, a dedicated sensor may be installed in the ink tank 5.

According to the present exemplary embodiment, detection of the "empty state" of the reservoir tank 4 is performed by the system using the electrode 34. In this regard, the electrode 34 may detects only a full tank position (state) of the reservoir tank 4, and a dot counting system detection unit may be adopted which counts the number of discharges from the head 1 after detecting that the liquid surface becomes lower than the full tank position.

According to the present exemplary embodiment, the inside of the recording head is maintained under a negative pressure in a normal state by the height difference H (the water head difference) between the liquid surface in the reservoir tank 4 and the discharge port surface of the recording head. In addition, when the recording operation is performed, the ink is automatically supplied from the reservoir tank 4 to the recording head 1 by a capillary force of the recording head side. With respect to this method, a liquid delivery pump (not illustrated) may be disposed on a flow path 2 between the reservoir tank 4 and the recording head 1, and the ink in the reservoir tank 4 may be sucked by the liquid delivery pump and supplied to the recording head in a pressurized state.

According to the present exemplary embodiment, the opening and closing unit is configured with the on-off valve, however, the opening and closing unit may be any openable and closable configuration without limiting to the on-off valve. For example, the opening and closing unit may be configured with a pump which can interrupt the flow path when the driving is stopped or a flexible unit which can switch between the open state and the close state.

An ink jet recording apparatus according to a sixth exemplary embodiment of the present invention is described below with reference to FIG. 17.

Figure 17:
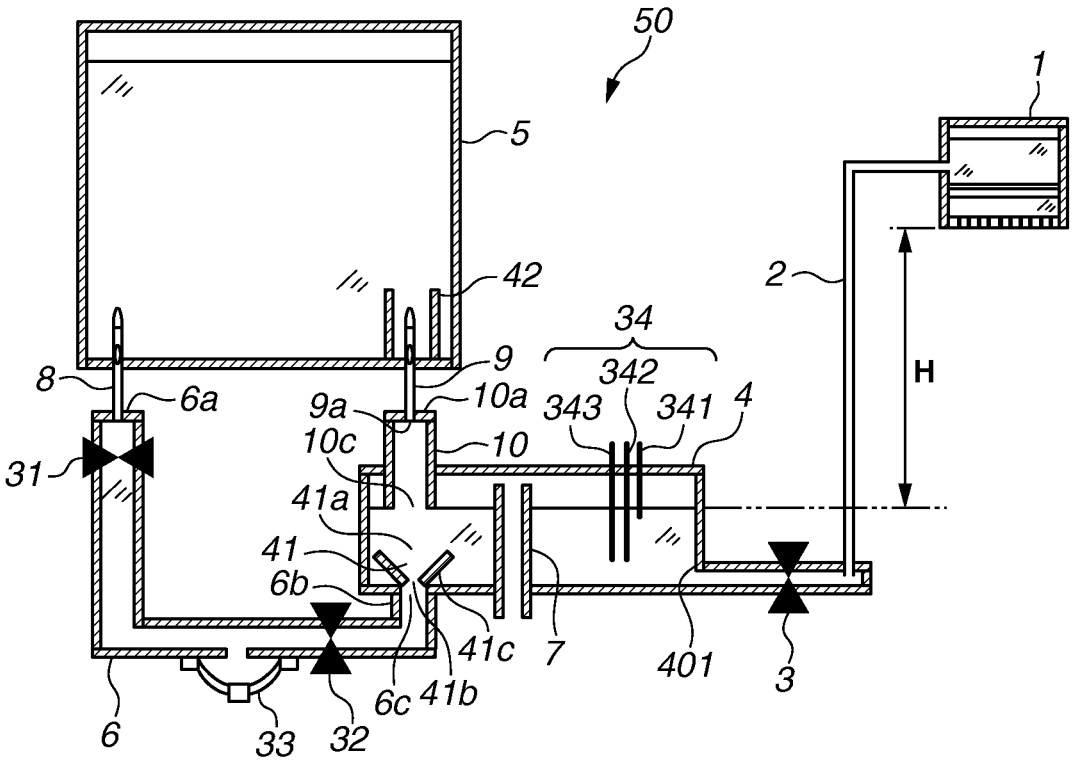
FIG. 17 is a schematic diagram illustrating ink flow paths of an ink jet recording apparatus according to a sixth exemplary embodiment of the present invention.

FIG. 17 is a schematic diagram illustrating ink flow paths of the ink jet recording apparatus according to the sixth exemplary embodiment of the present invention. As illustrated in FIG. 17, according to the present exemplary embodiment, the ink stirring mechanism (the circulation mechanism) includes an ink guide unit 41 in the reservoir tank 4.

According to the present exemplary embodiment, the ink guide unit 41 is disposed below the opening 10*c*. The ink guide unit 41 includes an opening 41*a* (an upward opening portion) facing the opening 10*c*, an opening 41*b* (a downward opening portion) facing the opening 6*c*, and a side portion 41*c* connecting the opening 41*a* and the opening 41*b*.

When viewed along the vertical direction, the opening 10*c* is disposed on the inside of the opening 41*a* of the ink guide unit 41. On the other hand, the opening 41*b* is disposed on the inside of the opening 6*c*. Therefore, when the circulation operation is performed, the (high concentration) ink flowing (falling) from the opening 10*c* is smoothly guided to the ink supply path 6 side.

In other words, when the ink is moved by the ink guide unit from the ink tank 5 to the reservoir tank 4 through the air introduction path 10, the ink flowing from the opening 10*c* to the reservoir tank 4 is collected by the ink guide unit 41 and guided to the ink supply path 6. Accordingly, the high concentration ink falling from the opening 10*c* is restrained from diffusing to the reservoir tank 4 and quickly collected (circulated) to the ink supply path 6.

Accordingly, when the circulation operation is performed, an influence of the high concentration ink flowing from the ink tank 5 on the ink concentration in the reservoir tank 4 becomes smaller. Especially, if the circulation operation is performed while performing the recording operation, the ink having a stable concentration can be supplied to the recording head side, and a higher recording quality can be maintained. In addition, if the circulation operation is performed, the high concentration ink is rarely accumulated in the reservoir tank 4, and thus the ink can be efficiently stirred.

An ink jet recording apparatus according to a seventh exemplary embodiment of the present invention is described below with reference to FIG. 18 and FIGS. 19A to 19D.

Figure 18:
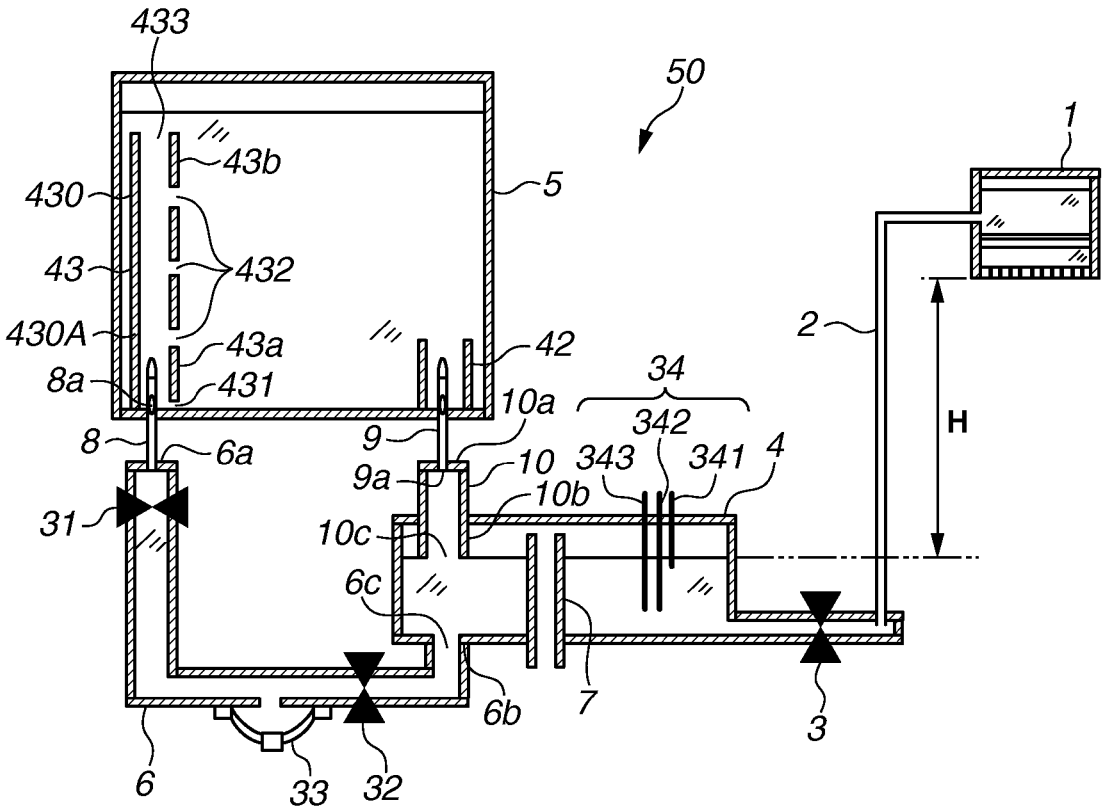
FIG. 18 is a schematic diagram illustrating ink flow paths of an ink jet recording apparatus according to a seventh exemplary embodiment of the present invention.

FIG. 18 is a schematic diagram illustrating ink flow paths of the ink jet recording apparatus according to the seventh exemplary embodiment of the present invention. As illustrated in FIG. 18, according to the present exemplary embodiment, the ink stirring mechanism (the circulation mechanism) includes, in the ink tank 5, an ink steering unit 43 for steering the ink.

The ink steering unit 43 can steer the ink flowing from an opening 8*a* (a third opening portion) of the ink supply path 6 (the hollow tube 8) into the ink tank 5 to flow upward at the time of the circulation operation. Accordingly, the ink in the ink tank 5 can be entirely stirred, and the stirring efficiency in the ink tank 5 and the reservoir tank 4 is further improved.

The ink steering unit 43 may be configured in such a manner that a "flow path resistance" when the ink flows out from the ink steering unit 43 to the ink tank 5 is smaller in an upper side than a lower side. In other words, the ink steering unit 43 may be configured to facilitate ink to flow upward when the ink is steered upward by the ink steering unit 43.

For example, according to the present exemplary embodiment, the ink steering unit 43 includes a cylindrical portion 430 standing from the bottom surface of the ink tank 5. The ink steering unit 43 further includes an opening 431 (a first open portion) disposed near the bottom of the ink tank 5 and an opening 432 (a second open portion) disposed on a position higher than the opening 431.

The opening 431 (the first open portion) and the opening 432 (the second open portion) are formed on a side wall 430A of the cylindrical portion 430. An opening 433 (a third open portion) is disposed on a leading edge 43*b* of the cylindrical portion 430.

The opening 432 (the second open portion) is formed larger than the opening 431 (the first open portion) in the ink steering unit 43. Thus, the ink flowing into the ink steering unit 43 from below can be smoothly steered upward.

For example, an opening area of the opening 431 may be set to 1 to 10 $mm^2$, and an opening area of the opening 432 may be set to 10 to 50 $mm^2$. Further, a diameter of the cylindrical portion 430 may be set to for example Φ3 to Φ9. The opening 431 and the opening 432 may be the same size (the opening area) with each other.

According to the present exemplary embodiment, the opening 431 (the first open portion) is disposed at a lowest position (near the bottom surface of the ink tank) of the cylindrical portion 430 (the side wall 430A), the ink in the ink tank can be used up when being supplied.

According to the present exemplary embodiment, a plurality of the openings 432 (the second open portions) is disposed in a height direction of the cylindrical portion 430. These openings 432 may be formed in the same size (the opening area), or the opening area of the opening 432 on an upper position may be larger than that of the opening 432 on a lower position. For example, the opening area may gradually become larger in an ascending order.

In addition, these openings 432 may be disposed at regular intervals in the height direction, or disposed in a manner that the interval becomes smaller in the ascending order.

As described above, settings such as the number, arrangement, and size of the openings may be appropriately changed as long as the ink is facilitated to flow from the opening on the upper part into the ink tank 5 rather than from the opening on the lower part in the cylindrical portion 430 when the circulation operation is performed.

The circulation operation according to the present exemplary embodiment is described below with reference to FIGS. 19A to 19D. FIGS. 19A to 19D illustrate the ink circulation operations in the ink tank and the reservoir tank according to the present exemplary embodiment. The control of the circulation operation according to the present exemplary embodiment is basically similar to the control of the circulation operation according to the fifth exemplary embodiment illustrated in FIG. 14C.

Figure 19A:
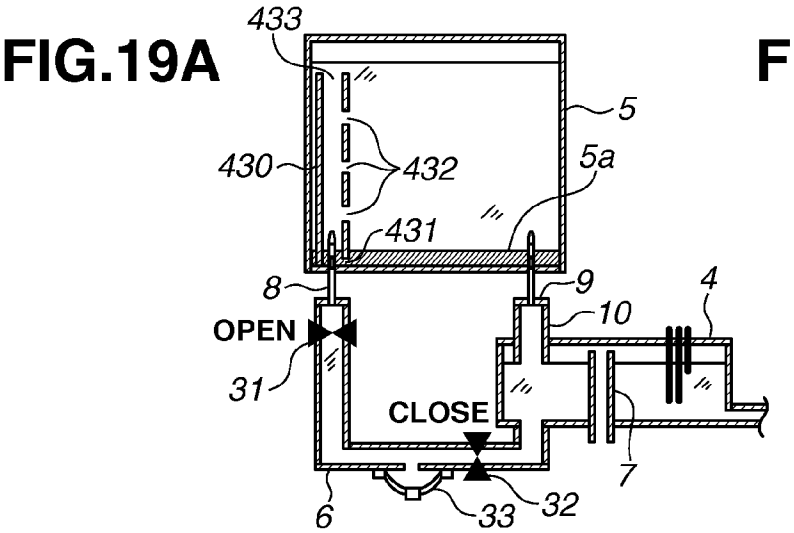
FIGS. 19A to 19D are schematic diagrams illustrating ink circulation operations in an ink tank and a reservoir tank according to the seventh exemplary embodiment.

As illustrated in FIG. 19A, when the circulation operation is performed, first in step S401, the second on-off valve 32 is closed, then in step S402, the first on-off valve 31 is opened.

Figure 19B:
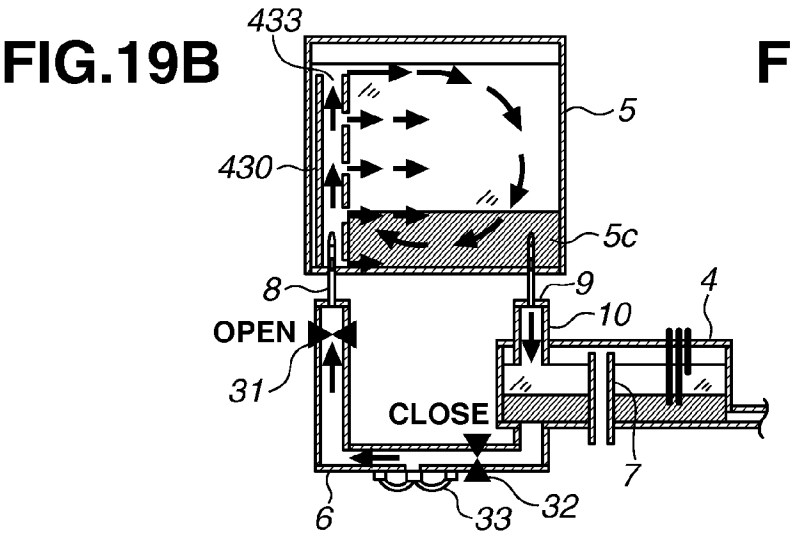

Next, as illustrated in FIG. 19B, the flexible unit 33 is reduced (in volume) and deformed. If the flexible unit 33 is reduced and deformed while the first on-off valve 31 is opened and the second on-off valve 32 is closed, the ink is not pushed out from the ink supply path 6 to the reservoir tank 4, and the ink corresponding to a changed amount in the flexible unit 33 is pushed out to the ink tank 5 side.

The ink flowing from the opening 8*a* (the third opening portion) of the ink supply path 6 into the ink tank 5 is steered to an upper part of the ink tank 5 by the cylindrical portion 430 (the ink steering unit 43), so that the inside of the ink tank 5 can be efficiently and entirely stirred.

Especially, according to the present exemplary embodiment, a plurality of the openings 432 is disposed along the height direction of the cylindrical portion 430 so as to make the flow resistance smaller in the upper part than that in the lower part of the cylindrical portion 430, and thus the ink pushed out to the ink tank 5 is facilitated to reach the upper part of the ink tank 5.

Figure 19C:
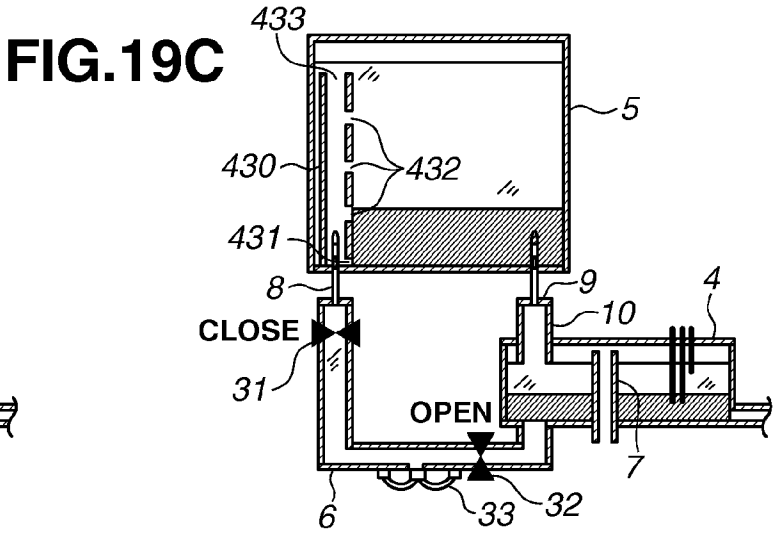
Figure 19D:
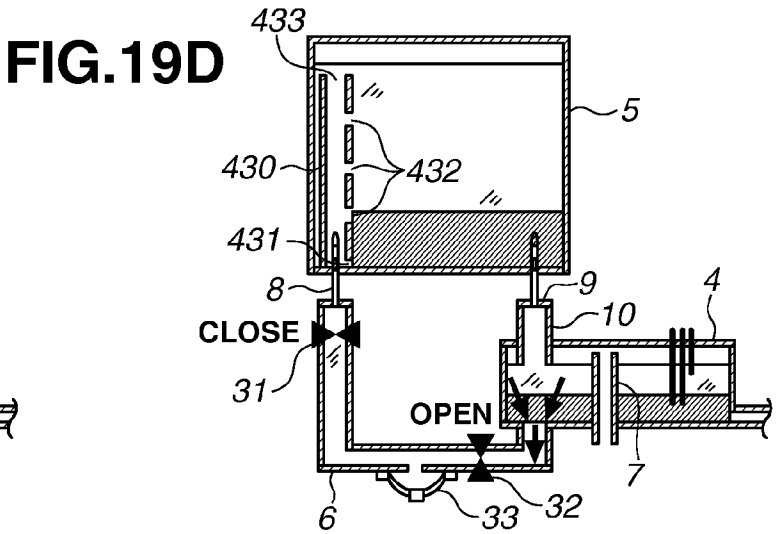

After the flexible unit 33 is reduced and deformed, in step S404, the first on-off valve 31 is closed, and in step S405, the second on-off valve 32 is opened as illustrated in FIG. 19C. Subsequently, in step S406, the flexible unit 33 is expanded (in volume) and deformed as illustrated in FIG. 19D.

As described above, a large flow of the ink is generated in the ink tank 5 by the ink steering unit, and also the ink is steered to the upper part of the ink tank 5. Accordingly, the ink in the ink tank 5 can be further entirely stirred, and the inks in the ink tank and the reservoir tank can be efficiently stirred. In addition, uniformalization of the ink concentrations in the ink tank 5 and the reservoir tank 4 can be realized more easily.

According to the present invention as described above in the fifth to the seventh exemplary embodiments, the ink in the first ink tank can be efficiently stirred by the ink stirring mechanism (the circulation mechanism). In addition, the ink concentrations in the first and the second ink tanks can be efficiently uniformed.

In other words, a large flow of the ink from the second ink tank to the first ink tank can be formed by the circulation mechanism, and the ink in the first ink tank can be stirred effectively. Further, the ink is circulated between the first and the second ink tanks with the large flow of the ink, and thus the inks in the first and the second ink tanks can be efficiently stirred.

When the first ink tank is effectively stirred, the stirring effect with respect to the ink in the ink tank or the reservoir tank is improved. Accordingly, the inks in the first and the second ink tanks can be efficiently stirred without increasing a size of the second ink tank. Thus, the ink stirring efficiency can be improved and the stirring time length can be shortened while suppressing the down-time of the ink supply apparatus or the ink jet recording apparatus.

According to the present invention, the inks in the ink tank and the reservoir tank can be efficiently stirred regardless of a size of the reservoir tank. In addition, when a volume and an operation rate of the ink stirring mechanism are increased, the present invention can be applied to a larger ink tank or a larger reservoir tank.

According to the present invention, the recording operation can be started while circulating and stirring the ink after the stirring operation of the reservoir tank, so that the down-time can be further reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2014-250406, filed Dec. 10, 2014, and No. 2015-193488, filed Sep. 30, 2015, which are hereby incorporated by reference herein in their entirety.

What is claimed is:

1. An ink jet recording apparatus comprising:

a first ink tank configured to store ink;

a second ink tank configured to store ink supplied from the first ink tank;

a recording head configured to discharge ink supplied from the second ink tank;

an ink supply path configured to supply ink from the first ink tank to the second ink tank;

a volume change unit disposed on the ink supply path and configured to change an internal volume, wherein the volume change unit allows ink to flow therein when the internal volume is expanded and to flow out when the internal volume is reduced;

a first valve disposed between the first ink tank and the volume change unit and configured to be switched between a first open state where the first ink tank communicates with the volume change unit and a first closed state where the first ink tank does not communicate with the volume change unit;

a second valve disposed between the volume change unit and the second ink tank and configured to be switched between a second open state where the volume change unit communicates with the second ink tank and a second closed state where the volume change unit does not communicate with the second ink tank; and a control unit configured to perform a first stirring operation in which ink in the first tank is stirred by changing the internal volume of the volume change unit under a state where the first valve is in the first open state and the second valve is in the second closed state, and perform a second stirring operation in which ink in the second tank is stirred by changing the internal volume of the volume change unit under a state where the second valve is in the second open state and the first valve is in the first closed state.

2. The ink jet recording apparatus according to claim 1, wherein the volume change unit is disposed on a lowest portion of the ink supply path in a direction of gravity.

3. The ink jet recording apparatus according to claim 1, wherein the ink stirring mechanism comprises:

an on-off valve configured to be able to open and close the ink supply path by switching between an open state and a close state;

a first volume change unit disposed between the on-off valve and the first ink tank and configured to be able to change an internal volume of its own; and a second volume change unit disposed between the on-off valve and the second ink tank and configured to be able to change an internal volume of its own, wherein the ink stirring mechanism performs the first stirring operation by changing the internal volume of the first volume change unit and performs the second stirring operation by changing the internal volume of the second volume change unit, under a state where the on-off valve is set in the close state.

4. The ink jet recording apparatus according to claim 1, wherein the ink stirring mechanism comprises:

an ink storage unit configured to be able to temporarily store ink;

a connection flow path configured to connect the ink storage unit and the ink supply path;

a supply unit disposed on the connection flow path and configured to be able to supply ink along a first direction and a second direction which is opposite to the first direction;

a first opening and closing unit disposed between the connection flow path and the first ink tank and configured to be able to open and close the ink supply path by switching between an open state and a close state; and a second opening and closing unit disposed between the connection flow path and the second ink tank and configured to be able to open and close the ink supply path by switching between an open state and a close state, wherein the ink stirring mechanism performs the first stirring operation by the supply unit under a state where the second opening and closing unit is set in the close state, and performs the second stirring operation by the supply unit under a state where the first opening and closing unit is set in the close state.

5. The ink jet recording apparatus according to claim 4, wherein the ink storage unit is configured with a member having flexibility capable of changing an internal volume of the ink storage unit.

6. The ink jet recording apparatus according to claim 1, wherein the ink stirring mechanism comprises:

a first volume change unit configured to be able to change an internal volume of its own and be able to set the ink supply path in an open state or a close state; and a second volume change unit configured to be able to change an internal volume of its own and be able to set the ink supply path in an open state or a close state, wherein the ink stirring mechanism performs the first stirring operation by changing the internal volume of the first volume change unit under a state where the ink supply path is set in the close state by the second volume change unit, and performs the second stirring operation by changing the internal volume of the second volume change unit under a state where the ink supply path is set in the close state by the first volume change unit.

7. The ink jet recording apparatus according to claim 1, wherein the ink stirring mechanism performs the second stirring operation before the first stirring operation.

8. The ink jet recording apparatus according to claim 1, wherein the first stirring operation and the second stirring operation are different operations.

9. The ink jet recording apparatus according to claim 1, wherein the second ink tank is disposed below the first ink tank and includes an atmosphere communication portion configured to communicate with atmosphere and an air introduction path configured to introduce air from the second ink tank to the first ink tank.

10. The ink jet recording apparatus according to claim 9, wherein an end of the ink supply path is connected to a bottom of the first ink tank, and another end thereof is connected to a bottom of the second ink tank, and an end of the air introduction path is connected to a bottom of the first ink tank, and another end thereof is connected to an upper portion of the second ink tank.

11. The ink jet recording apparatus according to claim 1, wherein the control unit performs the second stirring operation before the first stirring operation.

12. The ink jet recording apparatus according to claim 1, wherein the first stirring operation is started during a period when a recording operation by the recording head is performed.

13. The ink jet recording apparatus according to claim 1, wherein the second ink tank is disposed below the first ink tank and includes an atmosphere communication portion configured to communicate with atmosphere and an air introduction path configured to introduce air from the second ink tank to the first ink tank.

14. The ink jet recording apparatus according to claim 13, wherein an end of the ink supply path is connected to a bottom of the first ink tank, and another end thereof is connected to a bottom of the second ink tank, and an end of the air introduction path is connected to a bottom of the first ink tank, and another end thereof is connected to an upper portion of the second ink tank.

15. An ink jet recording apparatus comprising:

a first ink tank configured to store ink;

a second ink tank configured to store ink supplied from the first ink tank;

a recording head configured to discharge ink supplied from the second ink tank;

a flow path configured to connect the first ink tank and the second ink tank;

a volume change unit disposed on the flow path and configured to change an internal volume, wherein the volume change unit allows ink to flow therein when the internal volume is expanded and to flow out when the internal volume is reduced;

a first valve disposed between the first ink tank and the volume change unit and configured to be switched between an open state where the first ink tank communicates with the volume change unit and a closed state where the first ink tank does not communicate with the volume change unit; and a second valve disposed between the second ink tank and the volume change unit and configured to be switched between an open state where the volume change unit communicates with the second ink tank and a closed state where the volume change unit does not communicate with the second ink tank.

* * * * *